US010881138B2

(12) United States Patent
Saleem et al.

(10) Patent No.: US 10,881,138 B2
(45) Date of Patent: Jan. 5, 2021

(54) HEATING SMOKEABLE MATERIAL

(71) Applicant: BRITISH AMERICAN TOBACCO (INVESTMENTS) LIMITED, London (GB)

(72) Inventors: Fozia Saleem, London (GB); Thomas Woodman, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 529 days.

(21) Appl. No.: 14/382,198

(22) PCT Filed: Apr. 11, 2013

(86) PCT No.: PCT/EP2013/057539
§ 371 (c)(1),
(2) Date: Aug. 29, 2014

(87) PCT Pub. No.: WO2013/160112
PCT Pub. Date: Oct. 31, 2013

(65) Prior Publication Data

US 2015/0040925 A1 Feb. 12, 2015

(30) Foreign Application Priority Data

Apr. 23, 2012 (GB) ..... 1207039.7

(51) Int. Cl.
*A24F 47/00* (2020.01)
*H05B 3/14* (2006.01)
*H05B 3/42* (2006.01)

(52) U.S. Cl.
CPC ..... *A24F 47/008* (2013.01); *H05B 3/146* (2013.01); *H05B 3/42* (2013.01)

(58) Field of Classification Search
CPC .... A24F 47/008; B65D 81/3881; H05B 3/146
(Continued)

(56) References Cited

U.S. PATENT DOCUMENTS 844,272 A * 2/1907 Fate ..... A47J 39/00 220/361
912,986 A 2/1909 Aschenbrenner
(Continued)

FOREIGN PATENT DOCUMENTS

AT 507187 B1 3/2010
AT 508244 A4 12/2010
(Continued)

OTHER PUBLICATIONS

Machine Translation of KR 100757450. No date.*
(Continued)

*Primary Examiner* — Eric Yaary
*Assistant Examiner* — Russell E Sparks
(74) *Attorney, Agent, or Firm* — Patterson Thuente Pedersen, P.A.

(57) ABSTRACT

An apparatus including a film heater configured to heat smokeable material to volatilize at least one component of the smokeable material for inhalation. The film heater including a plurality of independently operable heating regions aligned with each other along a longitudinal axis of the film heater to provide a plurality of independent heating zones along the length of the film heater.

21 Claims, 8 Drawing Sheets

(58) Field of Classification Search
USPC ..... 131/328
See application file for complete search history.

(56) References Cited

U.S. PATENT DOCUMENTS 1,071,817 A 9/1913 Stanley
1,771,366 A 7/1930 Wyss
1,886,391 A 11/1932 Gauvin
2,057,353 A 10/1936 Whittemore
2,104,266 A 1/1938 McCormick
2,473,325 A 6/1949 Aufiero
2,809,634 A 10/1957 Hirotada et al.
3,111,396 A 11/1963 Ball
3,225,954 A 12/1965 Herrick
3,265,236 A 8/1966 Gibbon
3,402,724 A 9/1968 Blount et al.
3,431,393 A 3/1969 Katsuda et al.
3,433,632 A 3/1969 Elbert et al.
3,521,643 A 7/1970 Toth et al.
3,604,428 A 9/1971 Moukaddem
3,804,100 A 4/1974 Fariello
3,805,806 A 4/1974 Grihalva
3,889,690 A 6/1975 Guarnieri
3,964,902 A 6/1976 Fletcher et al.
4,009,713 A 3/1977 Simmons et al.
4,031,906 A 6/1977 Knapp
4,094,119 A 6/1978 Sullivan
4,145,001 A 3/1979 Weyenberg et al.
4,161,283 A 7/1979 Hyman
4,171,000 A 10/1979 Uhle
4,193,513 A 3/1980 Bull, Jr.
4,303,083 A 12/1981 Burruss, Jr.
4,412,930 A 11/1983 Koike et al.
4,427,123 A * 1/1984 Komeda ..... A47J 41/028 215/12.2
4,474,191 A 10/1984 Steiner
4,503,851 A 3/1985 Braunroth
4,588,976 A 5/1986 Jaselli
4,628,187 A * 12/1986 Sekiguchi ..... B60R 1/0602 219/505
4,638,820 A 1/1987 Roberts et al.
4,675,508 A 6/1987 Miyaji
4,676,237 A 6/1987 Wood et al.
4,677,992 A 7/1987 Bliznak
4,694,841 A 9/1987 Esparza
4,734,097 A 3/1988 Tanabe et al.
4,735,217 A 4/1988 Gerth et al.
4,756,318 A 7/1988 Clearman et al.
4,765,347 A 8/1988 Sensabaugh et al.
4,830,028 A 5/1989 Lawson et al.
4,848,374 A 7/1989 Chard et al.
4,885,129 A 12/1989 Leonard et al.
4,892,109 A 1/1990 Strubel
4,907,606 A 3/1990 Lilja et al.
4,917,301 A 4/1990 Munteanu
4,922,901 A 5/1990 Brooks et al.
4,945,929 A 8/1990 Egilmex
4,945,931 A 8/1990 Gori
4,947,874 A 8/1990 Brooks et al.
4,947,875 A 8/1990 Brooks
4,978,814 A 12/1990 Honour
5,027,837 A 7/1991 Clearman et al.
5,040,551 A 8/1991 Schlatter et al.
5,046,514 A 9/1991 Bolt
5,060,671 A 10/1991 Counts et al.
5,093,894 A * 3/1992 Deevi ..... A24F 47/008 392/390
5,095,647 A 3/1992 Zobele et al.
5,095,921 A 3/1992 Losee et al.
5,096,921 A 3/1992 Bollinger et al.
5,099,861 A 3/1992 Clearman et al.
5,121,881 A 6/1992 Lembeck
5,143,048 A 9/1992 Cheney, III
5,144,962 A 9/1992 Counts
5,167,242 A 12/1992 Turner et al.
5,179,966 A 1/1993 Losee et al.
5,190,060 A 3/1993 Gerding et al.
5,203,355 A 4/1993 Clearman et al.
5,224,498 A 7/1993 Deevi et al.
5,247,947 A 9/1993 Clearman et al.
5,249,586 A 10/1993 Morgan et al.
5,251,688 A 10/1993 Schatz
5,261,424 A 11/1993 Sprinkel, Jr.
5,269,327 A 12/1993 Counts et al.
5,271,980 A 12/1993 Bell
5,285,798 A 2/1994 Banerjee et al.
5,303,720 A 4/1994 Banerjee et al.
5,305,733 A 4/1994 Walters
5,322,075 A 6/1994 Deevi et al.
5,327,915 A 7/1994 Porenski et al.
5,331,979 A 7/1994 Henley
5,345,951 A 9/1994 Serrano et al.
5,353,813 A 10/1994 Deevi et al.
5,369,723 A 11/1994 Counts et al.
5,372,148 A 12/1994 McCafferty et al.
5,388,574 A 2/1995 Ingebrethsen
5,388,594 A 2/1995 Counts et al.
5,390,864 A 2/1995 Alexander
5,402,803 A 4/1995 Takagi
5,408,574 A 4/1995 Deevi et al.
5,434,388 A 7/1995 Kralik
5,468,936 A 11/1995 Deevi et al.
5,479,948 A 1/1996 Counts et al.
5,497,792 A 3/1996 Prasad et al.
5,501,236 A 3/1996 Hill et al.
5,505,214 A 4/1996 Collins et al.
5,530,225 A 6/1996 Hajaligol
5,534,020 A 7/1996 Cheney, III et al.
5,540,241 A 7/1996 Kim
5,553,791 A 9/1996 Alexander
5,573,140 A 11/1996 Satomi
5,573,692 A 11/1996 Das et al.
5,613,504 A 3/1997 Collins et al.
5,613,505 A 3/1997 Campbell et al.
5,636,787 A 6/1997 Gowhari
5,649,554 A 7/1997 Sprinkel et al.
5,665,262 A 9/1997 Hajaligol et al.
5,666,977 A 9/1997 Higgins et al.
5,692,291 A 12/1997 Deevi et al.
5,742,251 A 4/1998 Gerber
5,743,251 A 4/1998 Howell et al.
5,771,845 A 6/1998 Pistien et al.
5,798,154 A 8/1998 Bryan
5,865,185 A 2/1999 Collins et al.
5,865,186 A 2/1999 Volsey, II
5,984,953 A 11/1999 Sabin et al.
6,026,820 A 2/2000 Baggett, Jr. et al.
6,037,568 A 3/2000 Hatanaka et al.
6,040,560 A * 3/2000 Fleischhauer ..... A24F 47/008 128/202.21
6,058,711 A 5/2000 Maciaszek et al.
6,089,857 A 7/2000 Matsuura et al.
6,095,505 A 8/2000 Miller
6,116,231 A 9/2000 Sabin et al.
6,125,853 A 10/2000 Susa et al.
6,155,268 A 12/2000 Takeuchi
6,224,179 B1 5/2001 Wenning et al.
6,275,650 B1 8/2001 Lambert
6,289,889 B1 9/2001 Bell et al.
6,315,366 B1 11/2001 Post et al.
6,376,816 B2 4/2002 Cooper et al.
6,644,383 B2 11/2003 Joseph et al.
6,652,804 B1 11/2003 Neumann et al.
6,681,998 B2 1/2004 Sharpe et al.
6,701,921 B2 3/2004 Sprinkel, Jr. et al.
6,723,115 B1 4/2004 Daly
6,790,496 B1 9/2004 Levander et al.
6,827,080 B2 12/2004 Fish et al.
6,868,230 B2 3/2005 Gerhardinger
6,953,474 B2 10/2005 Lu
6,994,096 B2 2/2006 Rostami et al.
7,100,618 B2 9/2006 Dominguez
7,112,712 B1 9/2006 Ancell
7,263,282 B2 8/2007 Meyer

(56) References Cited

U.S. PATENT DOCUMENTS 7,374,063 B2 * 5/2008 Reid ..... F25B 9/02 220/592.27
7,400,940 B2 7/2008 McRae et al.
7,540,286 B2 6/2009 Cross et al.
7,624,739 B2 12/2009 Snaidr et al.
7,726,320 B2 * 6/2010 Robinson ..... A24F 47/008 131/200
7,767,698 B2 8/2010 Warchol et al.
7,832,410 B2 11/2010 Hon
7,913,688 B2 3/2011 Cross et al.
7,992,554 B2 8/2011 Radomski et al.
8,061,361 B2 11/2011 Maeder et al.
8,079,371 B2 12/2011 Robinson et al.
8,081,474 B1 12/2011 Zohni
8,118,021 B2 2/2012 Cho et al.
8,375,957 B2 2/2013 Hon
8,393,331 B2 3/2013 Hon
8,430,106 B2 4/2013 Potter et al.
8,490,628 B2 7/2013 Hon
8,511,318 B2 8/2013 Hon
8,678,013 B2 3/2014 Crooks et al.
8,689,805 B2 4/2014 Hon
8,752,545 B2 6/2014 Buchberger
8,757,404 B1 6/2014 Fleckenstein
8,807,140 B1 8/2014 Scatterday
8,833,364 B2 9/2014 Buchberger
8,899,238 B2 12/2014 Robinson et al.
8,948,578 B2 2/2015 Buchberger
9,357,803 B2 * 6/2016 Egoyants ..... A24F 47/004
9,414,619 B2 8/2016 Sizer et al.
9,414,629 B2 8/2016 Egoyants et al.
9,554,598 B2 1/2017 Egoyants et al.
9,609,894 B2 * 4/2017 Abramov ..... A24F 47/008
9,623,205 B2 4/2017 Buchberger
9,693,587 B2 7/2017 Plojoux et al.
9,980,523 B2 * 5/2018 Abramov ..... A24F 47/008
9,999,256 B2 * 6/2018 Abramov ..... A24F 47/008
1,001,069 A1 7/2018 Buchberger
1,004,556 A1 8/2018 Buchberger
2001/0042546 A1 11/2001 Umeda et al.
2002/0005207 A1 1/2002 Wrenn et al.
2002/0016370 A1 2/2002 Shytle et al.
2002/0079309 A1 6/2002 Cox
2002/0079377 A1 6/2002 Nichols
2003/0005620 A1 1/2003 Ananth et al.
2003/0049025 A1 3/2003 Neumann et al.
2003/0079309 A1 5/2003 Vandenbelt et al.
2003/0106552 A1 6/2003 Sprinkel, Jr. et al.
2003/0108342 A1 6/2003 Sherwood et al.
2003/0146224 A1 * 8/2003 Fujii ..... A47J 41/022 220/592.27
2003/0200964 A1 10/2003 Blakley et al.
2003/0202169 A1 10/2003 Liu
2004/0003820 A1 1/2004 Iannuzzi et al.
2004/0031485 A1 2/2004 Rustad et al.
2004/0096204 A1 5/2004 Gerhardinger
2004/0129793 A1 7/2004 Nguyen et al.
2004/0149296 A1 8/2004 Rostami et al.
2004/0149297 A1 8/2004 Sharpe
2004/0149737 A1 8/2004 Sharpe et al.
2004/0210151 A1 10/2004 Tsukashima et al.
2004/0226568 A1 11/2004 Takeuchi et al.
2005/0063686 A1 3/2005 Whittle et al.
2005/0145260 A1 7/2005 Inagaki et al.
2005/0194013 A1 9/2005 Wright
2005/0204799 A1 9/2005 Koch
2005/0211711 A1 9/2005 Reid
2005/0268911 A1 12/2005 Cross et al.
2006/0078477 A1 4/2006 Althouse et al.
2006/0137681 A1 6/2006 Von Hollen et al.
2007/0014549 A1 1/2007 Demarest et al.
2007/0045288 A1 3/2007 Nelson
2007/0062548 A1 3/2007 Horstmann et al.
2007/0074734 A1 * 4/2007 Braunshteyn ..... A24F 47/008 131/328
2007/0102013 A1 5/2007 Adams
2007/0107879 A1 5/2007 Radomski et al.
2007/0155255 A1 7/2007 Galauner et al.
2007/0204858 A1 9/2007 Abelbeck
2007/0204868 A1 9/2007 Bollinger et al.
2007/0283972 A1 12/2007 Monsees
2008/0085139 A1 4/2008 Roof
2008/0092912 A1 4/2008 Robinson et al.
2008/0156326 A1 7/2008 Belcastro et al.
2008/0216828 A1 9/2008 Wensley et al.
2008/0233318 A1 9/2008 Coyle
2008/0241255 A1 10/2008 Rose et al.
2008/0302374 A1 12/2008 Wengert et al.
2009/0032034 A1 2/2009 Steinberg
2009/0056728 A1 3/2009 Baker
2009/0065011 A1 3/2009 Maeder et al.
2009/0090472 A1 4/2009 Radomski
2009/0095311 A1 4/2009 Han
2009/0126745 A1 5/2009 Hon
2009/0151717 A1 6/2009 Bowen et al.
2009/0188490 A1 7/2009 Han
2009/0241947 A1 10/2009 Bedini et al.
2009/0260641 A1 10/2009 Monsees
2009/0272379 A1 11/2009 Thorens et al.
2009/0293892 A1 12/2009 Williams et al.
2009/0304372 A1 12/2009 Gubler et al.
2010/0059070 A1 3/2010 Potter et al.
2010/0065653 A1 3/2010 Wingo et al.
2010/0083959 A1 4/2010 Siller
2010/0108059 A1 5/2010 Axelsson et al.
2010/0126516 A1 5/2010 Yomtov et al.
2010/0147299 A1 * 6/2010 Row ..... H05B 3/46 128/203.27
2010/0200006 A1 8/2010 Robinson
2010/0236546 A1 9/2010 Yamada et al.
2010/0242974 A1 9/2010 Pan
2010/0242975 A1 9/2010 Hearn
2010/0300467 A1 12/2010 Kuistila et al.
2010/0307518 A1 * 12/2010 Wang ..... A24F 47/008 131/329
2011/0011396 A1 1/2011 Fang
2011/0036363 A1 2/2011 Urtsev et al.
2011/0090266 A1 4/2011 King et al.
2011/0094523 A1 * 4/2011 Thorens ..... A24F 47/008 131/194
2011/0126848 A1 6/2011 Zuber et al.
2011/0155153 A1 6/2011 Thorens et al.
2011/0155718 A1 6/2011 Greim
2011/0192914 A1 8/2011 Ishigami
2011/0226236 A1 9/2011 Buchberger
2011/0264084 A1 10/2011 Reid
2011/0277757 A1 11/2011 Terry et al.
2011/0290266 A1 12/2011 Koller
2011/0290267 A1 12/2011 Yamada et al.
2011/0297166 A1 12/2011 Takeuchi et al.
2011/0303231 A1 12/2011 Li et al.
2012/0006342 A1 1/2012 Rose et al.
2012/0132196 A1 5/2012 Vladyslavovych
2012/0145169 A1 6/2012 Wu
2012/0234821 A1 9/2012 Shimizu
2012/0255546 A1 10/2012 Goetz et al.
2012/0260927 A1 10/2012 Liu
2012/0285476 A1 11/2012 Hon
2013/0042865 A1 * 2/2013 Monsees ..... A61M 15/06 128/203.27
2013/0074857 A1 3/2013 Buchberger
2013/0081623 A1 4/2013 Buchberger
2013/0087160 A1 4/2013 Gherghe
2013/0133675 A1 5/2013 Shinozaki et al.
2013/0142782 A1 6/2013 Rahmel et al.
2013/0192615 A1 8/2013 Tucker et al.
2013/0213419 A1 8/2013 Tucker et al.
2013/0284192 A1 10/2013 Peleg et al.
2013/0306084 A1 11/2013 Flick
2013/0333700 A1 12/2013 Buchberger
2013/0340779 A1 12/2013 Liu
2014/0000638 A1 1/2014 Sebastian et al.
2014/0060528 A1 3/2014 Liu
2014/0060554 A1 3/2014 Collett et al.

(56) References Cited

U.S. PATENT DOCUMENTS

| | | | |
|---|---|---|---|
| 2014/0060555 | A1 | 3/2014 | Chang et al. |
| 2014/0182608 | A1 | 7/2014 | Egoyants et al. |
| 2014/0182843 | A1 | 7/2014 | Vinegar |
| 2014/0202454 | A1 | 7/2014 | Buchberger |
| 2014/0202476 | A1 | 7/2014 | Egoyants et al. |
| 2014/0209105 | A1 | 7/2014 | Sears et al. |
| 2014/0216485 | A1 | 8/2014 | Egoyants et al. |
| 2014/0238396 | A1 | 8/2014 | Buchberger |
| 2014/0238423 | A1 | 8/2014 | Tucker et al. |
| 2014/0238424 | A1 | 8/2014 | Macko et al. |
| 2014/0261490 | A1 | 9/2014 | Kane |
| 2014/0270726 | A1 | 9/2014 | Egoyants et al. |
| 2014/0270730 | A1 | 9/2014 | Depiano et al. |
| 2014/0283825 | A1 | 9/2014 | Buchberger |
| 2014/0286630 | A1 | 9/2014 | Buchberger |
| 2014/0299125 | A1 | 10/2014 | Buchberger |
| 2014/0305449 | A1 | 10/2014 | Plojoux et al. |
| 2014/0326257 | A1 | 11/2014 | Jalloul et al. |
| 2014/0334802 | A1 | 11/2014 | Dubief |
| 2014/0338680 | A1 | 11/2014 | Abramov et al. |
| 2014/0360515 | A1 | 12/2014 | Vasiliev et al. |
| 2015/0040925 | A1 | 2/2015 | Saleem et al. |
| 2015/0114411 | A1 | 4/2015 | Buchberger |
| 2015/0142088 | A1 | 5/2015 | Riva Godoy |
| 2015/0157055 | A1 | 6/2015 | Lord |
| 2015/0196058 | A1 | 7/2015 | Lord |
| 2015/0208728 | A1 | 7/2015 | Lord |
| 2015/0223520 | A1 | 8/2015 | Phillips et al. |
| 2016/0003403 | A1 | 1/2016 | Smith |
| 2016/0073693 | A1 | 3/2016 | Reevell |
| 2016/0106154 | A1 | 4/2016 | Lord |
| 2016/0106155 | A1 | 4/2016 | Reevell |
| 2016/0146506 | A1 | 5/2016 | Brereton et al. |
| 2016/0168438 | A1 | 6/2016 | Harding et al. |
| 2016/0255879 | A1 | 9/2016 | Paprocki et al. |
| 2017/0006916 | A1 | 1/2017 | Liu |
| 2017/0042245 | A1 | 2/2017 | Buchberger et al. |
| 2017/0095006 | A1 | 4/2017 | Egoyants et al. |
| 2017/0119048 | A1 | 5/2017 | Kaufman et al. |
| 2017/0119049 | A1 | 5/2017 | Blandino et al. |
| 2017/0119050 | A1 | 5/2017 | Blandino et al. |
| 2017/0156406 | A1 | 6/2017 | Abramov et al. |
| 2017/0156407 | A1 | 6/2017 | Abramov et al. |
| 2017/0197043 | A1 | 7/2017 | Buchberger |
| 2017/0197044 | A1 | 7/2017 | Buchberger |
| 2017/0197046 | A1 | 7/2017 | Buchberger |
| 2017/0197048 | A1 | 7/2017 | Khosrowshahi et al. |
| 2017/0197049 | A1 | 7/2017 | Doll |
| 2017/0197050 | A1 | 7/2017 | Reinburg et al. |
| 2017/0231281 | A1 | 8/2017 | Hatton et al. |
| 2017/0303585 | A1 | 10/2017 | Florack et al. |
| 2017/0332700 | A1 | 11/2017 | Plews et al. |
| 2017/0340008 | A1 | 11/2017 | Sebastian et al. |
| 2018/0271171 | A1 | 9/2018 | Abramov et al. |
| 2019/0000142 | A1 | 1/2019 | Lavanchy et al. |
| 2019/0014820 | A1 | 1/2019 | Malgat |

FOREIGN PATENT DOCUMENTS

| | | | |
|---|---|---|---|
| AT | 510405 | A4 | 4/2012 |
| AT | 510504 | A1 | 4/2012 |
| AU | 6393173 | A | 6/1975 |
| CA | 2309376 | A1 | 11/2000 |
| CA | 2712412 | A1 | 12/2009 |
| CH | 698603 | B1 | 9/2009 |
| CL | 199400288 | A1 | 8/1995 |
| CL | 199600626 | A1 | 4/1997 |
| CL | 2007002226 | A1 | 2/2008 |
| CL | 2013003637 | A1 | 7/2014 |
| CL | 2014002840 | A1 | 12/2014 |
| CN | 86102917 | | 11/1987 |
| CN | 1040914 | | 4/1990 |
| CN | 1045691 | | 10/1990 |
| CN | 2092880 | U | 1/1992 |
| CN | 1106812 | A | 8/1995 |
| CN | 2220168 | Y | 2/1996 |
| CN | 1122213 | A | 5/1996 |
| CN | 2246744 | Y | 2/1997 |
| CN | 119661 | | 10/1998 |
| CN | 1106812 | | 10/1998 |
| CN | 1195270 | | 10/1998 |
| CN | 1196660 | | 10/1998 |
| CN | 1205849 | A | 1/1999 |
| CN | 1312730 | A | 9/2001 |
| CN | 2598364 | | 1/2004 |
| CN | 1578895 | A | 2/2005 |
| CN | 2719043 | Y | 8/2005 |
| CN | 1694765 | A | 11/2005 |
| CN | 1703279 | A | 11/2005 |
| CN | 200966824 | Y | 10/2007 |
| CN | 101238047 | | 8/2008 |
| CN | 101267749 | | 9/2008 |
| CN | 101277622 | | 10/2008 |
| CN | 101282660 | A | 10/2008 |
| CN | 201185656 | | 1/2009 |
| CN | 201238609 | Y | 5/2009 |
| CN | 101500443 | A | 8/2009 |
| CN | 101516425 | A | 8/2009 |
| CN | 101557728 | | 10/2009 |
| CN | 201375023 | | 1/2010 |
| CN | 101648041 | A | 2/2010 |
| CN | 101878958 | A | 11/2010 |
| CN | 101925309 | | 12/2010 |
| CN | 102014677 | A | 4/2011 |
| CN | 201869778 | U | 6/2011 |
| CN | 102131411 | A | 7/2011 |
| CN | 202172846 | U | 3/2012 |
| CN | 102604599 | A | 7/2012 |
| CN | 102655773 | A | 9/2012 |
| CN | 202722498 | U | 2/2013 |
| CN | 202750708 | U | 2/2013 |
| CN | 103052380 | A | 4/2013 |
| CN | 103054196 | A | 4/2013 |
| CN | 103359550 | A | 10/2013 |
| CN | 203986095 | U | 12/2014 |
| CN | 106102863 | A | 11/2016 |
| DE | 1950439 | A1 | 4/1971 |
| DE | 3148335 | A1 | 7/1983 |
| DE | 3218760 | A1 | 12/1983 |
| DE | 3936687 | A1 | 5/1990 |
| DE | 29713866 | | 10/1997 |
| DE | 29719509 | U1 | 1/1998 |
| DE | 19630619 | A1 | 2/1998 |
| DE | 19654945 | A1 | 3/1998 |
| DE | 10330681 | B3 | 6/2004 |
| DE | 202006013439 | U1 | 10/2006 |
| DE | 102005023278 | A1 | 11/2006 |
| DE | 102010046482 | A1 | 3/2012 |
| DE | 202013100606 | U1 | 2/2013 |
| DE | 102013002555 | A1 | 6/2014 |
| EP | 0280262 | A2 | 8/1988 |
| EP | 0295122 | A2 | 12/1988 |
| EP | 0309227 | A2 | 3/1989 |
| EP | 0358002 | | 3/1990 |
| EP | 0358114 | | 3/1990 |
| EP | 0371285 | A2 | 6/1990 |
| EP | 0418464 | A2 | 3/1991 |
| EP | 0430559 | | 6/1991 |
| EP | 0430566 | A2 | 6/1991 |
| EP | 0438862 | | 7/1991 |
| EP | 0444553 | A2 | 9/1991 |
| EP | 0488488 | | 6/1992 |
| EP | 0491952 | A1 | 7/1992 |
| EP | 0503767 | | 9/1992 |
| EP | 0603613 | | 6/1994 |
| EP | 0845220 | | 6/1998 |
| EP | 0893071 | A1 | 1/1999 |
| EP | 1128743 | A1 | 9/2001 |
| EP | 1166814 | A2 | 1/2002 |
| EP | 1166847 | A2 | 1/2002 |
| EP | 0845220 | B1 | 9/2003 |
| EP | 1609376 | A1 | 12/2005 |
| EP | 1618803 | | 1/2006 |
| EP | 1736065 | | 12/2006 |

(56) References Cited

FOREIGN PATENT DOCUMENTS

| | | | | |
|---|---|---|---|---|
| EP | 1757921 | A2 | 2/2007 | |
| EP | 2011033 | A2 | 1/2009 | |
| EP | 2018886 | A1 | 1/2009 | |
| EP | 2022349 | | 2/2009 | |
| EP | 2110033 | | 10/2009 | |
| EP | 2113178 | A1 | 11/2009 | |
| EP | 1947965 | B1 | 2/2010 | |
| EP | 2316286 | A1 | 5/2011 | |
| EP | 2327318 | | 6/2011 | |
| EP | 2340729 | A1 | 7/2011 | |
| EP | 2340730 | | 7/2011 | |
| EP | 2394520 | | 12/2011 | |
| EP | 2520186 | A1 | 11/2012 | |
| EP | 2698070 | A1 | 2/2014 | |
| EP | 2762019 | A1 | 8/2014 | |
| EP | 2785208 | A1 | 10/2014 | |
| EP | 2835062 | A1 | 2/2015 | |
| EP | 2907397 | A1 | 8/2015 | |
| FR | 960469 | A | 4/1950 | |
| GB | 25575 | A | 3/1912 | |
| GB | 191126138 | A | 3/1912 | |
| GB | 426247 | | 3/1935 | |
| GB | 1313525 | A | 4/1973 | |
| HK | 1196511 | A1 | 10/2016 | |
| HK | 1226611 | | 10/2017 | |
| JP | S5314173 | A | 2/1978 | |
| JP | S5752456 | A | 3/1982 | |
| JP | S59106340 | A | 6/1984 | |
| JP | S6196763 | A | 5/1986 | |
| JP | S6196765 | A | 5/1986 | |
| JP | 62501050 | | 4/1987 | |
| JP | S62205184 | A | 9/1987 | |
| JP | S6360322 | A | 3/1988 | |
| JP | 6217980 | | 8/1988 | |
| JP | 63127399 | | 8/1988 | |
| JP | H01191674 | A | 8/1989 | |
| JP | H0292986 | A | 4/1990 | |
| JP | H0292988 | A | 4/1990 | |
| JP | H02124081 | A | 5/1990 | |
| JP | H02127493 | A | 5/1990 | |
| JP | H02190171 | A | 7/1990 | |
| JP | H0341185 | A | 2/1991 | |
| JP | H03112478 | A | 5/1991 | |
| JP | 03192677 | | 8/1991 | |
| JP | 03232481 | | 10/1991 | |
| JP | H05103836 | A | 7/1993 | |
| JP | H05212100 | A | 8/1993 | |
| JP | H05309136 | A | 11/1993 | |
| JP | H062164 | B1 | 1/1994 | |
| JP | 6189861 | | 7/1994 | |
| JP | 06315366 | | 11/1994 | |
| JP | H07147965 | A | 6/1995 | |
| JP | 478508 | | 6/1996 | |
| JP | 08000942 | | 6/1996 | |
| JP | H08299862 | A | 11/1996 | |
| JP | H08511176 | A | 11/1996 | |
| JP | 09107943 | | 4/1997 | |
| JP | 3044574 | U | 12/1997 | |
| JP | 1189551 | | 4/1999 | |
| JP | H11503912 | A | 4/1999 | |
| JP | 11125390 | | 5/1999 | |
| JP | 11169157 | | 6/1999 | |
| JP | H11514081 | A | 11/1999 | |
| JP | 2000119643 | A | 4/2000 | |
| JP | 2001063776 | A | 3/2001 | |
| JP | 2002527153 | A | 8/2002 | |
| JP | 2002529111 | A | 9/2002 | |
| JP | 2004332069 | A | 11/2004 | |
| JP | 2005036897 | | 2/2005 | |
| JP | 2005106350 | | 4/2005 | |
| JP | 2005524067 | A | 8/2005 | |
| JP | 2005300005 | | 10/2005 | |
| JP | 2005537918 | A | 12/2005 | |
| JP | 2005537919 | A | 12/2005 | |
| JP | 2005538149 | A | 12/2005 | |
| JP | 2005538159 | A | 12/2005 | |
| JP | 2006501871 | | 1/2006 | |
| JP | 2006219557 | A | 8/2006 | |
| JP | 2007057532 | A | 3/2007 | |
| JP | 2007512880 | A | 5/2007 | |
| JP | 2008249003 | | 10/2008 | |
| JP | 2009509523 | A | 3/2009 | |
| JP | 2009537119 | A | 10/2009 | |
| JP | 2009537120 | | 10/2009 | |
| JP | 2010506594 | | 3/2010 | |
| JP | 2010178730 | | 8/2010 | |
| JP | 2010213579 | | 9/2010 | |
| JP | 2011058538 | A | 3/2011 | |
| JP | 2011509667 | | 3/2011 | |
| JP | 2011515093 | A | 5/2011 | |
| JP | 2011518567 | A | 6/2011 | |
| JP | 2011525366 | A | 9/2011 | |
| JP | 2012506263 | A | 3/2012 | |
| JP | 2012249854 | A | 12/2012 | |
| JP | 5193668 | B2 | 5/2013 | |
| JP | 2014519586 | A | 8/2014 | |
| JP | 2015513922 | A | 5/2015 | |
| JP | 2015513970 | A | 5/2015 | |
| KR | 950700692 | A | 2/1995 | |
| KR | 19990081973 | A | 11/1999 | |
| KR | 200350504 | Y1 | 5/2004 | |
| KR | 200370872 | Y1 | 12/2004 | |
| KR | 100636287 | B1 | 10/2006 | |
| KR | 20070038350 | | 4/2007 | |
| KR | 100757450 | * | 9/2007 | ..... F25D 11/00 |
| KR | 1020080060218 | | 7/2008 | |
| KR | 20100135865 | A | 12/2010 | |
| KR | 20120003484 | U | 5/2012 | |
| KR | 20120104533 | A | 9/2012 | |
| KR | 20130006714 | U | 11/2013 | |
| MX | 2009001096 | A | 3/2009 | |
| MX | 2014011283 | A | 10/2014 | |
| RU | 2066337 | C1 | 9/1996 | |
| RU | 2098446 | C1 | 12/1997 | |
| RU | 2285028 | C1 | 10/2006 | |
| RU | 2311859 | C2 | 12/2007 | |
| RU | 2336001 | C2 | 10/2008 | |
| RU | 89927 | U1 | 12/2009 | |
| RU | 94815 | U1 | 6/2010 | |
| RU | 103281 | U1 | 4/2011 | |
| RU | 115629 | U1 | 5/2012 | |
| RU | 122000 | U1 | 11/2012 | |
| RU | 124120 | U1 | 1/2013 | |
| RU | 132318 | U1 | 9/2013 | |
| RU | 2509516 | C2 | 3/2014 | |
| WO | WO8602528 | | 5/1986 | |
| WO | WO 94/06134 | | 3/1994 | |
| WO | WO-9418860 | A1 | 9/1994 | |
| WO | WO 96/32854 | A | 10/1996 | |
| WO | WO-9748293 | A1 | 12/1997 | |
| WO | WO-9817131 | A1 | 4/1998 | |
| WO | WO-9823171 | A1 | 6/1998 | |
| WO | WO-0009188 | A1 | 2/2000 | |
| WO | WO-0021598 | A1 | 4/2000 | |
| WO | WO-0028842 | A1 | 5/2000 | |
| WO | WO-0050111 | A1 | 8/2000 | |
| WO | 01/67819 | A1 | 9/2001 | |
| WO | WO-02051468 | A2 | 7/2002 | |
| WO | WO-02058747 | A1 | 8/2002 | |
| WO | WO-03012565 | A1 | 2/2003 | |
| WO | WO-03028409 | A1 | 4/2003 | |
| WO | WO03037412 | | 5/2003 | |
| WO | WO-03050405 | A1 | 6/2003 | |
| WO | WO03059413 | | 7/2003 | |
| WO | WO-03070031 | A1 | 8/2003 | |
| WO | WO-03083283 | A1 | 10/2003 | |
| WO | WO-03101454 | A1 | 12/2003 | |
| WO | WO03103387 | | 12/2003 | |
| WO | WO-2004022128 | A2 | 3/2004 | |
| WO | WO-2004022242 | A1 | 3/2004 | |
| WO | WO-2004022243 | A1 | 3/2004 | |
| WO | WO-2004089126 | A1 | 10/2004 | |
| WO | WO-2005106350 | A2 | 11/2005 | |
| WO | WO-2006082571 | A1 | 8/2006 | |

(56) References Cited

FOREIGN PATENT DOCUMENTS

| | | | |
|---|---|---|---|
| WO | WO2007012007 | | 1/2007 |
| WO | WO2007017482 | | 2/2007 |
| WO | WO-2007040941 | A1 | 4/2007 |
| WO | WO-2007042941 | A2 | 4/2007 |
| WO | WO-2007131449 | A1 | 11/2007 |
| WO | WO2007131450 | | 11/2007 |
| WO | WO-2007141668 | A2 | 12/2007 |
| WO | WO-2008038144 | A2 | 4/2008 |
| WO | WO2008108889 | | 9/2008 |
| WO | WO-2008121610 | A1 | 10/2008 |
| WO | WO2009001082 | | 12/2008 |
| WO | WO-2009015410 | A1 | 2/2009 |
| WO | WO-2009022232 | A2 | 2/2009 |
| WO | WO2009092862 | | 7/2009 |
| WO | WO-2009118085 | A1 | 10/2009 |
| WO | WO-2009132793 | A1 | 11/2009 |
| WO | WO-2010045670 | A1 | 4/2010 |
| WO | WO-2010045671 | A1 | 4/2010 |
| WO | WO2010073018 | | 7/2010 |
| WO | WO-2010102832 | A1 | 9/2010 |
| WO | WO2010107613 | | 9/2010 |
| WO | WO2010118644 | | 10/2010 |
| WO | WO-2010133342 | A1 | 11/2010 |
| WO | WO-2011045609 | A1 | 4/2011 |
| WO | WO-2011050943 | A1 | 5/2011 |
| WO | WO2011050964 | | 5/2011 |
| WO | WO-2011063970 | A1 | 6/2011 |
| WO | WO-2011068020 | A1 | 6/2011 |
| WO | WO 2011/079932 | | 7/2011 |
| WO | WO-2011109849 | A1 | 9/2011 |
| WO | WO-2012014490 | A1 | 2/2012 |
| WO | WO-2012025496 | A1 | 3/2012 |
| WO | WO-2013022936 | A1 | 2/2013 |
| WO | WO 2013/034458 | A1 | 3/2013 |
| WO | WO-2013034453 | A1 | 3/2013 |
| WO | WO-2013034454 | A1 | 3/2013 |
| WO | WO-2013034459 | A1 | 3/2013 |
| WO | WO-2013034460 | A1 | 3/2013 |
| WO | WO-2013057185 | A1 | 4/2013 |
| WO | WO-2013082173 | A1 | 6/2013 |
| WO | WO-2013098395 | A1 | 7/2013 |
| WO | WO-2013113612 | A1 | 8/2013 |
| WO | WO-2013116558 | A1 | 8/2013 |
| WO | WO-2013116572 | A1 | 8/2013 |
| WO | WO-2013131764 | A1 | 9/2013 |
| WO | WO-2013152873 | A1 | 10/2013 |
| WO | WO-2013160112 | A2 | 10/2013 |
| WO | WO-2014012906 | A1 | 1/2014 |
| WO | WO-2014037794 | A2 | 3/2014 |
| WO | WO-2014045025 | A2 | 3/2014 |
| WO | WO-2014061477 | A1 | 4/2014 |
| WO | WO-2014130695 | A1 | 8/2014 |
| WO | WO-2014140320 | A1 | 9/2014 |
| WO | WO-2014150131 | A1 | 9/2014 |
| WO | WO-2014201432 | A1 | 12/2014 |
| WO | WO-2015114328 | A1 | 8/2015 |
| WO | WO-2015165812 | A1 | 11/2015 |
| WO | WO-2015177254 | A1 | 11/2015 |

OTHER PUBLICATIONS

New Super Insulator form Concept Group Stops Heat Conduction in Tight Spaces, Concept Group, Published Jun. 11, 2011, https://www.businesswire.com/news/home/20110610006023/en/New-Super-Insulator-Concept-Group-Stops-Heat. (Year: 2011).*

Definition of Film, Merriam-Webster Dictionary, https://www.merriam-webster.com/dictionary/film (Year: 2019).*

Application and File History for U.S. Appl. No. 14/127,138, filed Feb. 10, 2014, inventors Egoyants et al.

International Search Report and Written Opinion dated Jan. 9, 2013 for PCT/EP2012/066525 filed Aug. 24, 2012.

International Search Report and Written Opinion, dated Feb. 11, 2014 for PCT/EP2013/057539 filed Apr. 11, 2013.

Warrier et al., "Effect of the Porous Structure of Graphite on Atomic Hydrogen Diffusion and Inventory". Nucl. Fusion 47(2007) 1656-1663, DOI: 10.1088/0029-5515/47/12/003.

Davies et al., (1983) Metallic Foams: Their Production, Properties and Applications. Journal of Materials Science, vol. 18 (7). p. 1899-1911.

International Search Report dated Jul. 18, 2011 issued in corresponding International Patent Application No. PCT/AT2011/000123.

Office Action and Search Report (with English Translation) dated Apr. 27, 2015, for CN201280030681.5.

Office Action (with English Translation) dated Apr. 7, 2015 for JP2014519586.

International Search Report and Written Opinion, dated Jan. 9, 2013, for International Application No. PCT/EP2012/066523 filed Aug. 24, 2012.

International Preliminary Report on Patentability, dated Nov. 4, 2013, for International Application No. PCT/EP2012/066523 filed Aug. 24, 2012.

Search Report dated Mar. 24, 2015, for Chinese Patent Application No. 201280029767.6 filed Aug. 24, 2012 (including English Translation).

International Search Report and Written Opinion, dated Jan. 9, 2013 for International Application No. PCT/EP2012/066524, filed Aug. 24, 2012.

International Preliminary Report on Patentability, dated Oct. 17,2013 for International Application No. PCT/EP2012/066524, filed Aug. 24, 2012.

International Search Report and Written Opinion, dated Dec. 10, 2012, for PCT/EP2012/066485, filed Aug. 24, 2012.

Written Opinion, dated Oct. 15, 2013, for PCT/EP2012/066485, filed Aug. 24, 2012.

International Search Report and Written Opinion, dated Jan. 9, 2013, for International Application No. PCT/EP2012/066484, filed Aug. 24, 2012.

First Office Action (dated Jun. 15, 2015) and Search Report (dated Jun. 2, 2015) for Chinese Patent Application No. 201280029784.X filed Aug. 24, 2012.

Office Action (with English translation) dated Mar. 31, 2015, for JP2014-519585, referencing JP2010-506594, JP03-0232481, JP2010-213579, JP62-17980, JP 2006-501871, JP4-78508 and JP62-501050.

International Search Report and Written Opinion for PCT/EP2012/066486 dated Jan. 14, 2013.

International Preliminary Report on Patentability (IPRP) dated Oct. 22, 2013 for PCT/EP2012/0664860.

Chinese First Office Action for Chinese Patent Application No. 201380021387.2 dated Dec. 3, 2015. English Translation provided.

Application and File History for U.S. Appl. No. 14/127,879, filed May 9, 2014, inventors Egoyants et al.

Application and File History for U.S. Appl. No. 13/583,381, filed Dec. 17, 2012, inventor Buchberger.

Chinese 2nd Office Action for Chinese Application No. 201380021387.2 dated Jul. 8, 2016.

Chinese Search Report (First Search) for Chinese Application No. 201380021387.2 dated Dec. 3, 2015.

Korean Office Action for Korean Application No. 10-2014-7032958 dated Aug. 17, 2016. English translation not available.

Second Office Action issued by the Chinese Patent Office for Chinese Patent Application No. 201380048636.7 dated Jan. 16, 2017.

Japanese Office Action, Japanese Patent Application No. 2015-506185, dated Sep. 29, 2015, 3 pages.

Chilean Office Action, Application No. 2014-002840, dated Jul. 20, 2017, 7 pages.

National Plastic Heater, Sensor and Control Inc., 'Kapton (Polyimide) Flexible Heaters', 2011, retrieved Feb. 19, 2018, <URL: https://www.kapton-silicone-flexible-heaters.com/products/kapton_polyimide_flexible_heaters.html>.

Australian Examination Report, Application No. 2016204192, dated Feb. 21, 2018, 7 pages.

Korean Office Action, Korean Application No. 10-2017-7008071, dated May 11, 2018, 8 pages. (17 pages with translation).

(56) References Cited

OTHER PUBLICATIONS

Russian Office Action, Application No. 2018101312, dated Jul. 4, 2018, 8 pages (11 pages with English summary).
Korean Office Action, Application No. 10-2013-7033866, dated Jul. 27, 2018, 12 pages (22 pages with translation).
Notice of EP Opposition by Fontem Ventures B.V., Application No. 12750765.5, dated Sep. 25, 2018, 22 pages.
Notice of EP Opposition by JT International S.A., Application No. 12750765.5, dated Sep. 26, 2018, 67 pages.
Translation of Korean Office Action, Application No. 10-2018-7019884, dated Apr. 5, 2019, 8 pages.
Vietnamese Opposition, dated Jun. 29, 2018, No. PD1-2018-00459, filed Apr. 27, 2018, Application No. 1-2014-03877, 35 pages.
Mod-Tronic Instruments Limited, Bulletin HS-202(B), *Thermofoil Heaters*, 60 pages, as available at https://confluence.esss.lu.se/download/attachments/29655295/EH_Minco_heater%20copy.pdf7api=v2, retrieved on Mar. 2, 2020.
Translation of Third Chinese Office Action, Application No. 201610804046.8, dated Mar. 25, 2019, 17 pages.
Application and File History for U.S. Appl. No. 15/991,512, filed May 29, 2018, inventors Abramov et al.
Application and File History for U.S. Appl. No. 14/927,537, filed Oct. 30, 2015, inventors Kaufman et al.
Application and File History for U.S. Appl. No. 14/927,539, filed Oct. 30, 2015, inventors Blandino et al.
Application and File History for U.S. Appl. No. 14/927,551, filed Oct. 30, 2015, inventors Blandino et al.
Application and File History for U.S. Appl. No. 14/927,556, filed Oct. 30, 2015, inventors Blandino et al.
Application and File History for U.S. Appl. No. 14/899,629, filed Dec. 18, 2015, inventors Brereton et al.
Application and File History for U.S. Appl. No. 14/902,663, filed Jan. 4, 2016, inventors Harding et al.
Application and File History for U.S. Appl. No. 15/470,078, filed Mar. 27, 2017, inventor Buchberger.
Application and File History for U.S. Appl. No. 15/470,089, filed Mar. 27, 2017, inventor Buchberger.
Application and File History for U.S. Appl.No. 15/470,095, filed Mar. 27, 2017, inventor Buchberger.
Application and File History for U.S. Appl. No. 14/962,817, filed Dec. 8, 2015, inventors Egoyants et al.
Application and File History for U.S. Appl. No. 15/437,522, filed Feb. 21, 2017, inventors Abramov et al.
Application and File History for U.S. Appl. No. 14/127,133, filed Jul. 15, 2014, inventors Vasiliev et al.
Application and File History for U.S. Appl. No. 14/127,144, filed Mar. 31, 2014, inventors Egoyants et al.
Application and File History for U.S. Appl. No. 14/127,148, filed Mar. 12, 2014, inventors Egoyants et al.
Application and File History for U.S. Appl. No. 14/343,368, filed Jun. 24, 2014, inventors Abramov et al.
Application and File History for U.S. Appl. No. 14/382,198, filed Aug. 29, 2014, inventors Saleem et al.
Application and File History for U.S. Appl. No. 15/379,946, filed Dec. 15, 2016, inventors Egoyants et al.
Application and File History for U.S. Appl. No. 15/437,517, filed Feb. 21, 2017, inventors Abramov et al.
Collier J.G. et al., "10.3 Mechanism of Evaporation and Condensation," Convective Boiling and Condensation, Third Edition, Clarendon Press, 1994, 6 pages.
Company Filtrona Richmond Inc., http://www.filtronaporoustechnologies.com, Nov. 19, 2018, 1 page.
Concept Group, "Insulon® Thermal Barrier from Concept Group Blocks Heat with Hyper-Deep Vacuum™," Dec. 15, 2011, 1 page.
Decision to Grant a Patent dated Nov. 15, 2016 for Japanese Application No. 2015-506185 filed Apr. 11, 2013, 5 pages.
Decision to Grant a Patent dated May 22, 2018 for Japanese Application No. 2016-134648, 5 pages.
Decision to Grant dated Apr. 1, 2014 for Russian Application No. 2011120430, 16 pages.
Decision to Grant dated Aug. 5, 2014 for Japanese Application No. 2011-532464, 6 pages.
Decision to Grant dated May 22, 2018 for Japanese Application No. 2016-134648, 6 pages.
Diener Electronic, "Plasma Polymerization," The company Diener electronic GmbH+Co. KG, Retrieved on Oct. 17, 2017, 19 pages.
Dunn P.D., et al., "Heat Pipes," Fourth Edition, Pergamon, ISBN0080419038, 1994, 14 pages.
English Translation for Vietnam Opposition for Application No. PCT/EP2013/057539, mailed on Jun. 29, 2018, 29 pages.
European Extended Search Report for European Application No. 201576220, dated May 28, 2020, 12 pages.
Examination Report for New Zealand Application No. 718007 dated Aug. 1, 2016, 4 pages.
Examination Report dated Jan. 9, 2019 for Philippines Application No. 1/2016/500805, 6 pages.
Extended European Search Report for Application No. 15178588, dated Apr. 14, 2016, 2 pages.
Extended European Search Report for Application No. 15200661.5, dated May 18, 2016, 6 pages.
Extended European Search Report for Application No. 16166656, dated Oct. 11, 2016, 9 pages.
Extended European Search Report for Application No. 17189951.1, dated Jan. 4, 2018, 11 pages.
Extended European Search Report for Application No. 18157257.9, dated Jun. 28, 2018, 7 pages.
Extended European Search Report for Application No. 18205608.5, dated Jul. 12, 2019, 7 pages.
Extended European search report for Application No. 20157622.0, dated May 28, 2020, 12 pages.
First Office Action dated Dec. 3, 2012 for Chinese Application No. 200980152395.4, 16 pages.
International Preliminary Report on Patentability for Application No. PCT/AT2012/000017, dated Aug. 13, 2013, 5 pages.
International Preliminary Report on Patentability for Application No. PCT/EP2012/066484, dated Mar. 20, 2014, 7 pages.
International Preliminary Report on Patentability for Application No. PCT/EP2012/066485, dated Dec. 20, 2013, 12 pages.
International Preliminary Report on Patentability for Application No. PCT/EP2012/070647, dated Apr 22, 2014, 8 pages.
International Preliminary Report on Patentability for Application No. PCT/EP2014/063785, dated Jun. 1, 2015, 12 pages.
International Preliminary Report on Patentability for Application No. PCT/EP2014/072828, dated May 12, 2016, 7 pages.
International Preliminary Report on Patentability for Application No. PCT/EP2015/064595, dated Oct. 25, 2016, 20 pages.
International Preliminary Report on Patentability for Application No. PCT/GB2014/051332, dated Nov. 12, 2015, 7 pages.
International Preliminary Report on Patentability for Application No. PCT/GB2014/051333, dated Aug. 5, 2015, 12 pages.
International Preliminary Report on Patentability for Application No. PCT/GB2014/051334, dated Nov. 12, 2015, 7 pages.
International Preliminary Report on Patentability for Application No. PCT/GB2015/051213, dated Jul. 14, 2016, 20 pages.
International Preliminary Report on Patentability for Application No. PCT/GB2017/051139, dated Aug. 6, 2018, 7 pages.
International Preliminary Report on Patentability for Application No. PCT/US2012/066523, dated Jun. 4, 2015, 6 pages.
International Preliminary Report on Patentability for Application No. PCT/EP2013/057539, dated Nov. 6, 2014, 10 pages.
International Search Report and Written Opinion for Application No. PCT/AT2012/000017, dated Jul. 3, 2012, 6 pages.
International Search Report and Written Opinion for Application No. PCT/EP2012/003103, dated Nov. 26, 2012, 6 pages.
International Search Report and Written Opinion for Application No. PCT/EP2012/070647, dated Feb. 6, 2013, 9 pages.
International Search Report and Written Opinion for Application No. PCT/EP2014/063785, dated Oct. 30, 2014, 10 pages.
International Search Report and Written Opinion for Application No. PCT/EP2014/064365, dated Oct. 7, 2014, 11 pages.
International Search Report and Written Opinion for Application No. PCT/EP2014/072828, dated Jun. 16, 2015, 10 pages.

(56) References Cited

OTHER PUBLICATIONS

International Search Report and Written Opinion for Application No. PCT/GB2014/051332, dated Jul. 21, 2014, 8 pages.
International Search Report and Written Opinion for Application No. PCT/GB2014/051333, dated Jul. 17, 2014, 10 pages.
International Search Report and Written Opinion for Application No. PCT/GB2014/051334, dated Jul. 21, 2014, 8 pages.
International Search Report and Written Opinion for Application No. PCT/GB2017/051139, dated Aug. 9, 2017, 14 pages.
International Search Report and Written Opinion for Application No. PCT/US2012/066523, dated May 29, 2013, 7 pages.
International Search Report and Written Opinion for Application No. PCT/AT2011/000123, dated Jul. 18, 2011, 8 pages.
International Search Report for Application No. PCT/AT2009/000413, dated Jan. 25, 2010, 3 pages.
International Search Report for Application No. PCT/AT2009/000414, dated Jan. 26, 2010, 2 pages.
International Search Report for Application No. PCT/EP2015/064595, dated Jan. 5, 2016, 6 pages.
International Search Report for Application No. PCT/GB2015/051213, dated Jul. 16, 2015, 5 pages.
Korean Office Action, Application No. 10-2019-7037986, dated Feb. 6, 2020, 11 pages.
Kynol, "Standard Specifications of Kynol™ Activated Carbon Fiber Products," Sep. 19, 2013, 2 pages.
International Preliminary Report on Patentability for Application No. PCT/EP2012/066525, dated Mar. 20, 2014, 8 pages.
Notice of Opposition dated Mar. 7, 2017 for European Application No. 12750770.5, 22 pages.
Notice of Opposition Letter from EPO Opposition against the European Application No. 2358418, dated Mar. 1, 2017, 60 pages.
Notice of Reasons for Rejection dated May 23, 2017 for Japanese Application No. 2016134648, 18 pages.
Notice of Reasons for Rejection dated May 31, 2016 for Japanese Application No. 2015- 137361, 6 pages.
Notice of Reasons for Rejection dated Oct. 7, 2013 for Japanese Application No. 2011532464, 6 pages.
Notice of Reasons for Rejection dated Sep. 8, 2015 for Japanese Application No. 2014179732, 5 pages.
Notification to Grant Patent Right for Invention dated Oct. 25, 2018 for Chinese Application No. 201610086101.4, 2 pages.
Office Action dated Jan. 23, 2019 for Korean Application No. 20187017575, 9 pages.
Office Action and Search Report dated Feb. 28, 2019 for Japanese Application No. 2018- 088088, 25 pages.
Office Action dated Sep. 6, 2017 for Korean Application No. 10-2017-7017425, 9 pages.
Office Action dated Sep. 6, 2017 for Korean Application No. 10-2017-7017430, 9 pages.
Office Action dated Jan. 11, 2019 for European Application No. 12750771.3, 44 pages.
Office Action dated Sep. 11, 2017 for Chinese Application No. 201480024988.3, 10 pages.
Office Action dated Apr. 12, 2017 for Russian Application No. 2016103729, filed Jul. 4, 2014, 15 pages.
Office Action dated Nov. 13, 2017 for Chinese Application No. 2013800472843, 13 pages.
Office Action dated Nov. 14, 2017 for Japanese Application No. 2016-522550, 6 pages.
Office Action dated Jan. 18, 2017 for Chinese Application No. 201480024978.X, 8 pages.
Office Action dated Jul. 18, 2018 for Chinese Application No. 201580022356.8, 15 pages.
Office Action dated Mar. 20, 2019 for Korean Application No. 10-2017-7008071, 2 pages.
Office Action dated Mar. 20, 2019 for Korean Application No. 10-2017-7008071, 3 pages.
Office Action dated Sep. 22, 2017 for Russian Application No. 2014120213, 11 pages.
Office Action dated Apr. 24, 2019 for Chinese Application No. 201710413187.1, 16 pages.
Office Action dated Apr. 24, 2019 for Chinese Application No. 201710412726.X, 21 pages.
Office Action dated Jan. 24, 2019 for European Application No. 12750771.3, 40 pages.
Office Action dated Jan. 25, 2019 for European Application No. 12750771.3, 2 pages.
Office Action dated Jan. 25, 2019 for European Application No. 17189951.1, 4 pages.
Office Action dated Dec. 26, 2017 for Chinese Application No. 201480059966.0, 29 pages.
Office Action dated Oct. 26, 2016 for Russian Application No. 2014120213, 7 pages.
Office Action dated Jun. 27, 2017 for Japanese Application No. 2016-527295, 8 pages.
Office Action dated Aug. 28, 2019 for Indian Application No. 201647014549, 6 pages.
Office Action dated Jul. 28, 2017 for Korean Application No. 10-2016-7010831, 11 pages.
Office Action dated Aug. 3, 2018 for Chinese Application No. 201580034981.4, 17 pages.
Office Action dated Dec. 30, 2016 for Chinese Application No. 201480024988.3, 26 pages.
Office Action dated Sep. 30, 2018 for Chinese Application No. 201610371843.1, 8 pages.
Office Action dated Jan. 31, 2017 for Japanese Application No. 2016-522550, 7 pages.
Office Action dated Dec. 4, 2018 for Japanese Application No. 2016-575543, 19 pages.
Office Action dated Jul. 4, 2017 for Japanese Application No. 2016-522550, 7 pages.
Office Action dated May 4, 2018 for Chinese Application No. 201610086101.4, 7 pages.
Office Action dated Dec. 5, 2017 for Japanese Application No. 2016-564977, 6 pages.
Office Action dated May 9, 2017 for Chinese Application No. 201480037049.2, 28 pages.
Office Action mailed for Japanese Application No. 2017-017842, dated Dec. 12, 2017, 6 pages.
Patio Kits Direct, "Insulated Roof Panels," DIY Alumawood Patio Cover Kits, dated Sep. 20, 2018, as available at https://www.patiokitsdirect.com/about-insulation, 2 pages.
Rudolph G., "The Influence of CO2 on the Sensory Characteristics of the Favor-System," 1987, Accessed at http://legacy.library.ucsf.edu/tid/sld5f100, 24 pages.
Search Report for Brazilian Patent Application No. 112013032558.5, dated Sep. 10, 2019, 4 pages.
Search Report dated Apr. 14, 2017 for Japanese Application No. 2016-134648, 31 pages.
Search Report dated Sep. 19, 2013 for Japanese Application No. 2011-532464, 116 pages.
Search Report dated Apr. 24, 2017 for Russian Application No. 2015146843, 3 pages.
Search Report dated Apr. 25, 2018 for Chinese Application No. 201610086101.4, 1 page.
Search Report dated Aug. 25, 2015 for Japanese Application No. 2014-179732, 10 pages.
Search Report dated Oct. 25, 2017 for Japanese Application No. 2016-864977, 19 pages.
Search Report dated Apr. 29, 2019 for Russian Application No. 2018137501, 12 pages.
Second Office Action dated Aug. 20, 2013 for Chinese Application No. 200980152395.4, 16 pages.
Vietnam Opposition for Application No. PCT/EP2013/057539, dated Jun. 29, 2018, 6 pages.
Written Opinion for Application No. PCT/EP2015/064595, dated Jan. 5, 2016, 11 pages.
Written Opinion for Application No. PCT/GB2015/051213, dated Jul. 16, 2015, 9 pages.

(56) References Cited

OTHER PUBLICATIONS

Written Opinion of the International Preliminary Examining Authority for Application No. PCT/EP2015/064595, dated Jun. 13, 2016, 8 pages.

* cited by examiner

HEATING SMOKEABLE MATERIAL

CROSS-REFERENCE TO RELATED APPLICATIONS

This application is the National Stage of International Application No. PCT/EP2013/057539, filed Apr. 11, 2013, which in turn claims priority to and benefit of British Patent Application No. GB1207039.7, filed Apr. 23, 2012. The entire contents of the aforementioned applications are herein expressly incorporated by reference.

FIELD

The invention relates to heating smokeable material.

BACKGROUND

Smoking articles such as cigarettes and cigars burn tobacco during use to create tobacco smoke. Attempts have been made to provide alternatives to these smoking articles by creating products which release compounds without creating tobacco smoke. Examples of such products are so-called heat-not-burn products which release compounds by heating, but not burning, tobacco.

SUMMARY

According to the invention, there is provided an apparatus comprising a film heater configured to heat smokeable material to volatilize at least one component of the smokeable material for inhalation.

The film heater may be a polyimide film heater.

The heater may have a thickness of less than 1 mm.

The heater may have a thickness of less than 0.5 mm.

The heater may have a thickness of between approximately 0.2 mm and 0.0002 mm.

The apparatus may comprise thermal insulation integrated with the heater.

The apparatus may comprise thermal insulation lined with the heater.

The apparatus may comprise thermal insulation separated from the heater by a barrier.

The barrier may comprise a layer of stainless steel.

The thermal insulation may comprise a core region which is evacuated to a lower pressure than an exterior of the insulation.

Wall sections of the insulation either side of the core region may converge to a sealed gas outlet.

A thickness of the insulation may be less than approximately 1 mm.

A thickness of the insulation may be less than approximately 0.1 mm.

A thickness of the insulation may be between approximately 1 mm and 0.001 mm.

The apparatus may comprise a mouthpiece for inhaling volatized components of the smokeable material.

The apparatus may be configured to heat the smokeable material without combusting the smokeable material.

In accordance with the invention, there is provided a method of manufacturing the apparatus and a method of heating smokeable material using the apparatus.

The insulation may be located between a smokeable material heating chamber and an exterior of the apparatus to reduce heat loss from heated smokeable material.

The insulation may be located co-axially around the heating chamber.

The smokeable material heating chamber may comprise a substantially tubular heating chamber and the insulation may be located around a longitudinal surface of the tubular heating chamber.

The insulation may comprise a substantially tubular body of insulation located around the heating chamber.

The smokeable material heating chamber may be located between the insulation and a heater.

A heater may be located between the smokeable material heating chamber and the insulation.

The insulation may be located externally of the heater.

The heater may be located co-axially around the heating chamber and the insulation may be located co-axially around the heater.

The insulation may comprise an infra-red radiation-reflective material to reduce the propagation of the infra-red radiation through the insulation.

The insulation may comprise an exterior wall which encloses the core region.

An internal surface of the wall may comprise an infra-red radiation-reflective coating to reflect infra-red radiation within the core region.

The wall may comprise a layer of stainless steel having a thickness of at least approximately 100 microns.

Wall sections either side of the core region may be connected by a joining wall section which follows an indirect path between the sections either side of the core region.

A pressure in the core region may be between approximately 0.1 and approximately 0.001 mbar.

A heat transfer coefficient of the insulation may be between approximately 1.10 $W/(m^2K)$ and approximately 1.40 $W/(m^2K)$ when a temperature of the insulation is in a range of from 150 degrees Celsius to 250 degrees Celsius.

The core region may comprise a porous material.

The converging wall sections may converge in an end region of the insulation.

The heater may be electrically-powered.

For exemplary purposes only, embodiments of the invention are described below with reference to the accompanying figures in which:

DETAILED DESCRIPTION

Figure 1:
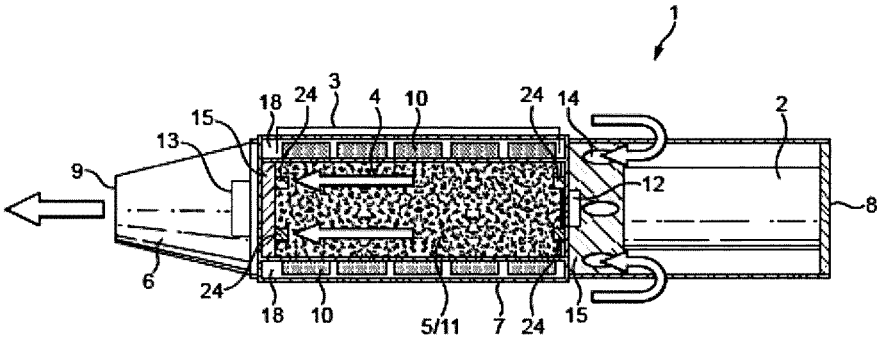
FIG. 1 is a schematic, cross sectional illustration of an apparatus configured to heat smokeable material to release aromatic compounds and/or nicotine from the smokeable material.

As used herein, the term 'smokeable material' includes any material that provides volatilized components upon heating and includes any tobacco-containing material and may, for example, include one or more of tobacco, tobacco derivatives, expanded tobacco, reconstituted tobacco or tobacco substitutes.

An apparatus 1 for heating smokeable material comprises an energy source 2, a heater 3 and a heating chamber 4. The energy source 2 may comprise a battery such as a Li-ion battery, Ni battery, Alkaline battery and/or the like, and is electrically coupled to the heater 3 to supply electrical energy to the heater 3 when required. The heating chamber 4 is configured to receive smokeable material 5 so that the smokeable material 5 can be heated in the heating chamber 4. For example, the heating chamber 4 may be located adjacent to the heater 3 so that thermal energy from the heater 3 heats the smokeable material 5 therein to volatilize aromatic compounds and nicotine in the smokeable material 5 without burning the smokeable material 5. A mouthpiece 6 is provided through which a user of the apparatus 1 can inhale the volatilized compounds during use of the apparatus 1. The smokeable material 5 may comprise a tobacco blend.

A housing 7 may contain components of the apparatus 1 such as the energy source 2 and heater 3. As shown in FIG. 1, the housing 7 may comprise an approximately cylindrical tube with the energy source 2 located towards its first end 8 and the heater 3 and heating chamber 4 located towards its opposite, second end 9. The energy source 2 and heater 3 extend along the longitudinal axis of the housing 7. For example, as shown in FIG. 1, the energy source 2 and heater 3 can be aligned along the central longitudinal axis of the housing 7 in a substantially end-to-end arrangement so that an end face of the energy source 2 faces an end face of the heater 3. The length of the housing 7 may be approximately 130 mm, the length of energy source may be approximately 59 mm, and the length of the heater 3 and heating region 4 may be approximately 50 mm. The diameter of the housing 7 may be between approximately 15 mm and approximately 18 mm. For example, the diameter of the housing's first end 8 may be 18 mm whilst the diameter of the mouthpiece 6 at the housing's second end 9 may be 15 mm. The diameter of the heater 3 may be between approximately 2.0 mm and approximately 6.0 mm. The diameter of the heater 3 may, for example, be between approximately 4.0 mm and approximately 4.5 mm or between approximately 2.0 mm and approximately 3.0 mm. Heater diameters and thicknesses outside these ranges may alternatively be used. For example, the diameter of the housing 7 and size of the apparatus 1 as a whole can be reduced significantly by the use of the film heater 3 and vacuum insulation 18 described below. The depth of the heating chamber 4 may be approximately 5 mm and the heating chamber 4 may have an exterior diameter of approximately 10 mm at its outwardly-facing surface. The diameter of the energy source 2 may be between approximately 14.0 mm and approximately 15.0 mm, such as 14.6 mm. However, an energy source 2 with a smaller diameter could alternatively be used. Heat insulation may be provided between the energy source 2 and the heater 3 to prevent direct transfer of heat from one to the other. The mouthpiece 6 can be located at the second end 9 of the housing 7, adjacent the heating chamber 4 and smokeable material 5. The housing 7 is suitable for being gripped by a user during use of the apparatus 1 so that the user can inhale volatilized smokeable material compounds from the mouthpiece 6 of the apparatus 1.

The heater 3 may comprise a film heater 3 such as a film polyimide heater 3. An example is a heater 3 comprising KAPTON® polyimide film. Other materials could alternatively be used. The film heater 3 has high tensile strength and high resistance to tearing. The dielectric strength of the heater 3 may be approximately 1000 VAC. The film heater 3 has a small thickness, such as less than 1 mm, which can contribute significantly in reducing the size of the apparatus 1 compared to the use of other types of heaters. An example thickness of the film 3 is approximately 0.2 mm, although heaters 3 with smaller and larger thickness dimensions can alternatively be used. For example, the thickness of the film heater 3 may be as low as approximately 0.0002 mm. The power output of the heater 3 may be between approximately 5 $W/cm^2$ and approximately 8 $W/cm^2$, although the power output may be lower and may be controlled, as required, over time. The film heater 3 may optionally be transparent, thereby allowing easy inspection of its internal structure. Such ease of inspection may be beneficial for quality control and maintenance tasks. The film heater 3 may incorporate one or more etched foil heating elements for heating the smokeable material in the heating chamber 4. The operating temperature of the heater 3 may, for example, be up to approximately 260° C. The apparatus 1 may comprise a Resistance Temperature Detector (RTD) or a thermocouple for use with controlling the temperature of the heater 3. Sensors may be mounted to a surface of the heater 3, which are configured to send resistance measurements to a controller 12 so that the controller 12 can maintain or adjust the temperature of the heater 3 as required. For example, the controller 12 may cycle the heater 3 at a set temperature for a predetermined period of time or may vary the temperature in accordance with a heating regime. The controller 12 and examples of heating regimes are described in more detail below. The film heater 3 has a low mass and therefore its use can help to reduce the overall mass of the apparatus 1.

As shown in FIG. 1, the heater 3 may comprise a plurality of individual heating regions 10. The heating regions 10 may be operable independently of one another so that different regions 10 can be activated at different times to heat the smokeable material 5. The heating regions 10 may be arranged in the heater 3 in any geometric arrangement. However, in the example shown in FIG. 1, the heating regions 10 are geometrically arranged in the heater 3 so that different ones of the heating regions 10 are arranged to predominately and independently heat different regions of the smokeable material 5.

Figure 2:
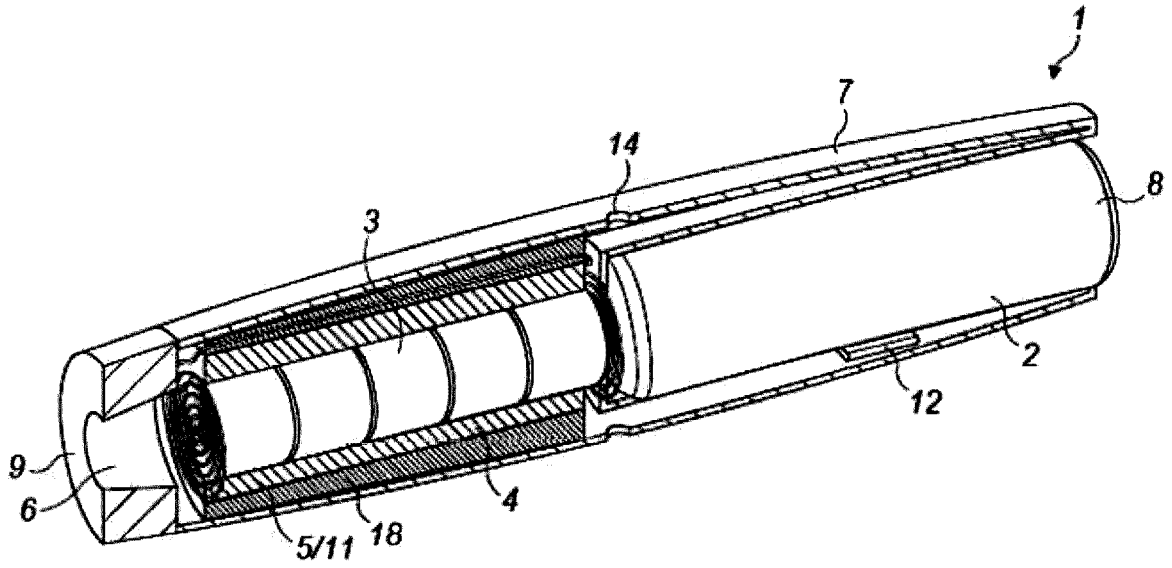
FIG. 2 is a perspective, partially cut-away illustration of an apparatus configured to heat smokeable material to release aromatic compounds and/or nicotine from the smokeable material.
Figure 3:
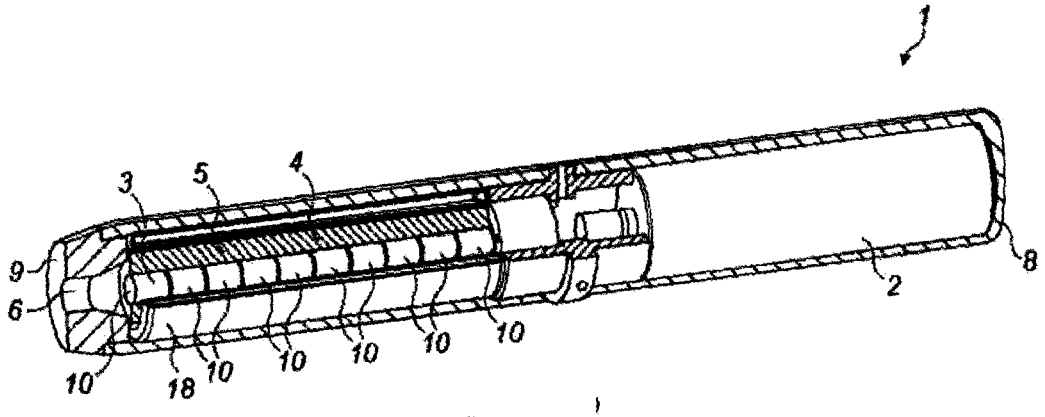
FIG. 3 is a perspective, partially cut-away illustration of an apparatus configured to heat smokeable material, in which the smokeable material is provided around an elongate ceramic heater divided into radial heating sections.

For example, referring to FIGS. 1 and 2, the heater 3 may comprise a plurality of axially aligned heating regions 10 in a substantially elongate arrangement. The regions 10 may each comprise an individual element of the heater 3. The heating regions 10 may, for example, all be aligned with each other along a longitudinal axis of the heater 3, thus providing a plurality of independent heating zones along the length of the heater 3.

Referring to FIG. 1, each heating region 10 may comprise a hollow heating cylinder 10, which may be a ring 10, having a finite length which is significantly less than the length of the heater 3 as a whole. The arrangement of axially aligned heating regions 10 define the exterior of the heating chamber 4 and are configured to heat smokeable material 5 located in the heating chamber 4. The heat is applied inwardly, predominately towards the central longitudinal axis of the heating chamber 4. The heating regions 10 are arranged with their radial, or otherwise transverse, surfaces facing one another along the length of the heater 3. The transverse surfaces of each heating region 10 may be separated from the transverse surfaces of their neighbouring heating region(s) 10 by thermal insulation 18, as shown in FIG. 1 and described below.

As shown in FIG. 2, the heater 3 may alternatively be located in a central region of the housing 7 and the heating chamber 4 and smokeable material 5 may be located around the longitudinal surface of the heater 3. In this arrangement, thermal energy emitted by the heater 3 travels outwards from the longitudinal surface of the heater 3 into the heating chamber 4 and the smokeable material 5.

The heating regions 10 may each comprise an individual element of the heater 3. As shown in FIGS. 1 and 2, each heating region 10 may comprise a heating cylinder 10 having a finite length which is significantly less than the length of the heater 3 as a whole. However, other configurations of heater 3 could alternatively be used and so the use of cylindrical sections of film heater 3 is not required. The heating regions 10 may be arranged with their transverse surfaces facing one another along the length of the heater 3. The transverse surfaces of each region 10 may touch the transverse surfaces of its neighbouring regions 10. Alternatively, a heat insulating or heat reflecting layer may be present between the transverse surfaces of the regions 10 so that thermal energy emitted from each one of the regions 10 does not substantially heat the neighbouring regions 10 and instead travels predominately into the heating chamber 4 and smokeable material 5. Each heating region 10 may have substantially the same dimensions as the other regions 10.

In this way, when a particular one of the heating regions 10 is activated, it supplies thermal energy to the smokeable material 5 located adjacent, for example radially adjacent, the heating region 10 without substantially heating the remainder of the smokeable material 5. Referring to FIG. 2, the heated region of smokeable material 5 may comprise a ring of smokeable material 5 located around the heating region 10 which has been activated. The smokeable material 5 can therefore be heated in independent sections, for example rings or substantially solid cylinders, where each section corresponds to smokeable material 5 located directly adjacent a particular one of the heating regions 10 and has a mass and volume which is significantly less than the body of smokeable material 5 as a whole.

Additionally or alternatively, the heater 3 may comprise a plurality of elongate, longitudinally extending heating regions 10 positioned at different locations around the central longitudinal axis of the heater 3. The heating regions 10 may be of different lengths, or may be of substantially the same length so that each extends along substantially the whole length of the heater 3.

The heated sections of smokeable material 5 may comprise longitudinal sections of smokeable material 5 which lie parallel and directly adjacent to the longitudinal heating regions 10. Therefore, as explained previously, the smokeable material 5 can be heated in independent sections.

As will be described further below, the heating regions 10 can each be individually and selectively activated.

The smokeable material 5 may be comprised in a cartridge 11 which can be inserted into the heating chamber 4. For example, as shown in FIG. 1, the cartridge 11 can comprise a substantially solid body of smokeable material 5 such as a cylinder which fits into a recess of the heater 3. In this configuration, the external surface of the smokeable material body faces the heater 3. Alternatively, as shown in FIG. 2, the cartridge 11 can comprise a smokeable material tube 11 which can be inserted around the heater 3 so that the internal surface of the smokeable material tube 11 faces the longitudinal surface of the heater 3. The smokeable material tube 11 may be hollow. The diameter of the hollow centre of the tube 11 may be substantially equal to, or slightly larger than, the diameter or otherwise transverse dimension of the heater 3 so that the tube 11 is a close fit around the heater 3. The length of the cartridge 11 may be approximately equal to the length of the heater 3 so that the heater 3 can heat the cartridge 11 along its whole length.

The housing 7 of the apparatus 1 may comprise an opening through which the cartridge 11 can be inserted into the heating chamber 4. The opening may, for example, comprise an opening located at the housing's second end 9 so that the cartridge 11 can be slid into the opening and pushed directly into the heating chamber 4. The opening is preferably closed during use of the apparatus 1 to heat the smokeable material 5. Alternatively, a section of the housing 7 at the second end 9 is removable from the apparatus 1 so that the smokeable material 5 can be inserted into the heating chamber 4. The apparatus 1 may optionally be equipped with a user-operable smokeable material ejection unit, such as an internal mechanism configured to slide used smokeable material 5 off and/or away from the heater 3. The used smokeable material 5 may, for example, be pushed back through the opening in the housing 7. A new cartridge 11 can then be inserted as required.

Figure 4:
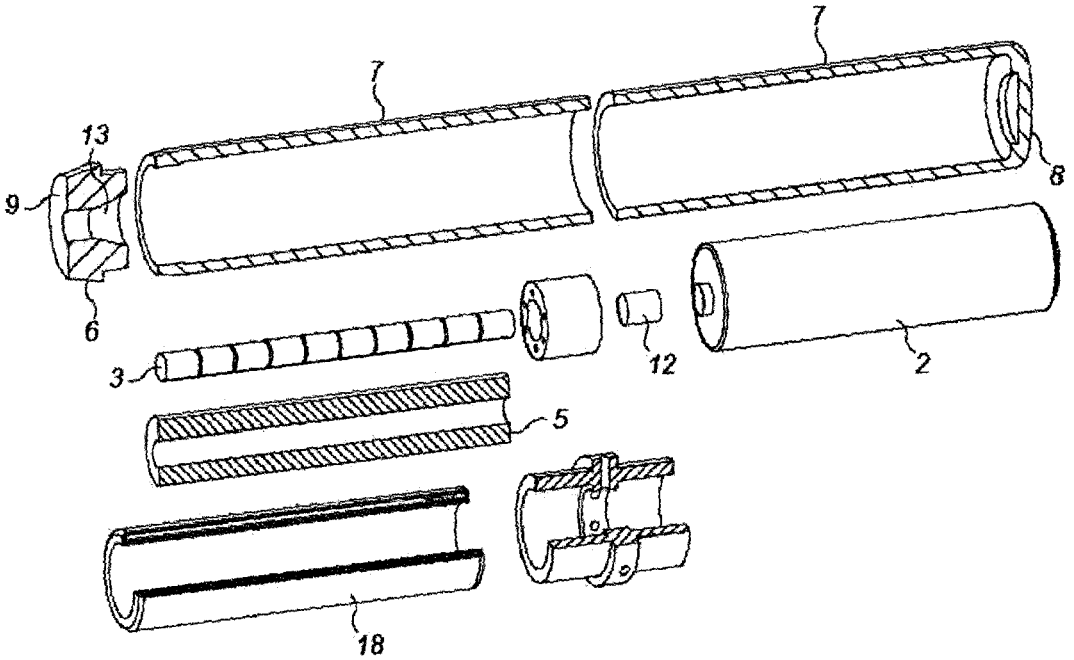
FIG. 4 is an exploded, partially cut-away view of an apparatus configured to heat smokeable material, in which the smokeable material is provided around an elongate ceramic heater divided into radial heating sections.

As mentioned previously, the apparatus 1 may comprise a controller 12, such as a microcontroller 12, which is configured to control operation of the apparatus 1. The controller 12 is electronically connected to the other components of the apparatus 1 such as the energy source 2 and heater 3 so that it can control their operation by sending and receiving signals. The controller 12 is, in particular, configured to control activation of the heater 3 to heat the smokeable material 5. For example, the controller 12 may be configured to activate the heater 3, which may comprise selectively activating one or more heating regions 10, in response to a user drawing on the mouthpiece 6 of the apparatus 1. In this regard, the controller 12 may be in communication with a puff sensor 13 via a suitable communicative coupling. The puff sensor 13 is configured to detect when a puff occurs at the mouthpiece 6 and, in response, is configured to send a signal to the controller 12 indicative of the puff. An electronic signal may be used. The controller 12 may respond to the signal from the puff sensor 13 by activating the heater 3 and thereby heating the smokeable material 5. The use of a puff sensor 13 to activate the heater 3 is not, however, essential and other means for providing a stimulus to activate the heater 3 can alternatively be used. For example, the controller 12 may activate the heater 3 in response to another type of activation stimulus such as actuation of a user-operable actuator. The volatilized compounds released during heating can then be inhaled by the user through the mouthpiece 6. The controller 12 can be located at any suitable position within the housing 7. An example position is between the energy source 2 and the heater 3/heating chamber 4, as illustrated in FIG. 4.

If the heater 3 comprises two or more heating regions 10 as described above, the controller 12 may be configured to activate the heating regions 10 in a predetermined order or pattern. For example, the controller 12 may be configured to activate the heating regions 10 sequentially along or around the heating chamber 4. Each activation of a heating region 10 may be in response to detection of a puff by the puff sensor 13 or may be triggered in an alternative way, as described further below.

Figure 5:
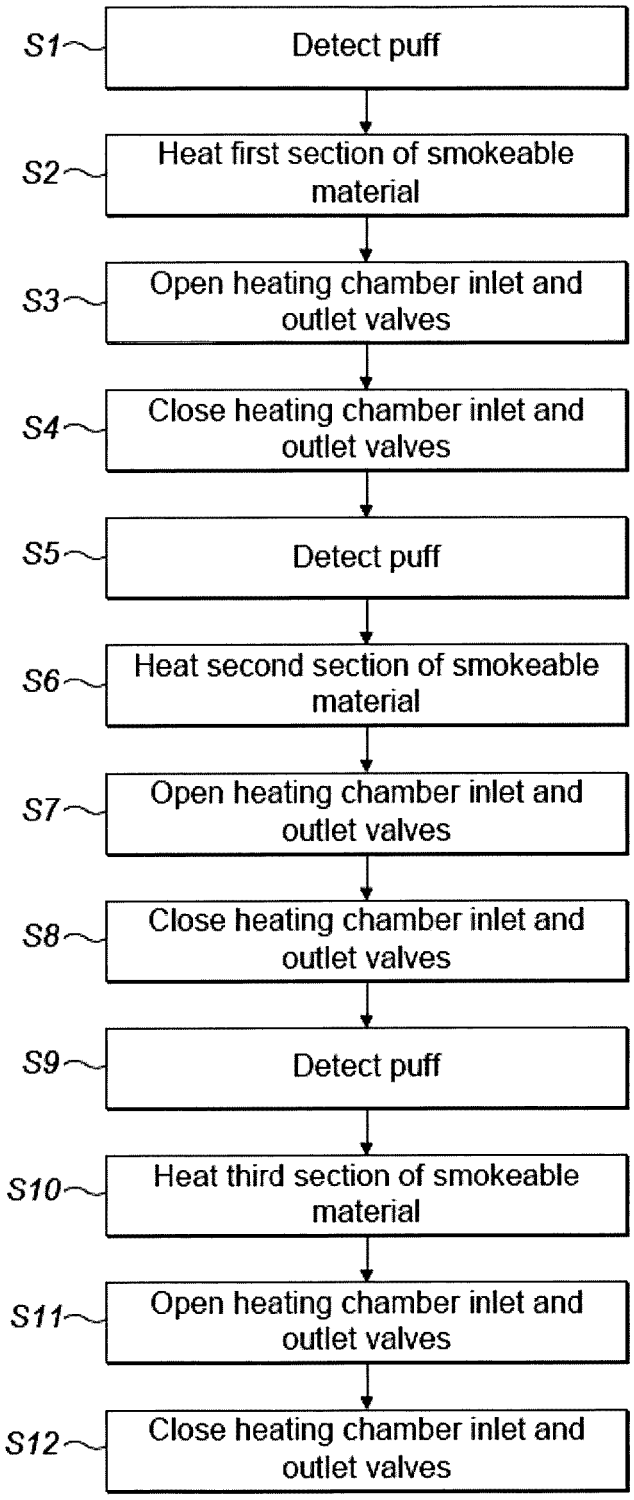
FIG. 5 is a flow diagram showing a method of activating heating regions and opening and closing heating chamber valves during puffing.

Referring to FIG. 5, an example heating method may comprise a first step S1 in which an activation stimulus such as a first puff is detected followed by a second step S2 in which a first section of smokeable material 5 is heated in response to the first puff or other activation stimulus. In a third step S3, hermetically sealable inlet and outlet valves 24 may be opened to allow air to be drawn through the heating chamber 4 and out of the apparatus 1 through the mouthpiece 6. In a fourth step, the valves 24 are closed. These valves 24 are described in more detail below with respect to FIG. 20. In fifth S5, sixth S6, seventh S7 and eighth S8 steps, a second section of smokeable material 5 may be heated in response to a second activation stimulus such as a second puff, with a corresponding opening and closing of the heating chamber inlet and outlet valves 24. In ninth S9, tenth S10, eleventh S11 and twelfth S12 steps, a third section of the smokeable material 5 may be heated in response to a third activation stimulus such as a third puff with a corresponding opening and closing of the heating chamber inlet and outlet valves 24, and so on. As referred to above, means other than a puff sensor 13 could alternatively be used. For example, a user of the apparatus 1 may actuate a control switch to indicate that he/she is taking a new puff. In this way, a fresh section of smokeable material 5 may be heated to volatilize nicotine and aromatic compounds for each new puff. The number of heating regions 10 and/or independently heatable sections of smokeable material 5 may correspond to the number of puffs for which the cartridge 11 is intended to be used. Alternatively, each independently heatable smokeable material section 5 may be heated by its corresponding heating region(s) 10 for a plurality of puffs such as two, three or four puffs, so that a fresh section of smokeable material 5 is heated only after a plurality of puffs have been taken whilst heating the previous smokeable material section.

Instead of activating each heating region 10 in response to an individual puff, the heating regions 10 may alternatively be activated sequentially, one after the other, in response to a single, initial puff at the mouthpiece 6. For example, the heating regions 10 may be activated at regular, predetermined intervals over the expected inhalation period for a particular smokeable material cartridge 11. The inhalation period may, for example, be between approximately one and approximately four minutes. Therefore, at least the fifth and ninth steps S5, S9 shown in FIG. 5 are optional. Each heating region 10 may be activated for a predetermined period corresponding to the duration of the single or plurality of puffs for which the corresponding independently heatable smokeable material section 5 is intended to be heated. Once all of the heating regions 10 have been activated for a particular cartridge 11, the controller 12 may be configured to indicate to the user that the cartridge 11 should be changed. The controller 12 may, for example, activate an indicator light at the external surface of the housing 7.

It will be appreciated that activating individual heating regions 10 in order rather than activating the entire heater 3 means that the energy required to heat the smokeable material 5 is reduced over what would be required if the heater 3 were activated fully over the entire inhalation period of a cartridge 11. Therefore, the maximum required power output of the energy source 2 is also reduced. This means that a smaller and lighter energy source 2 can be installed in the apparatus 1.

Figure 7:
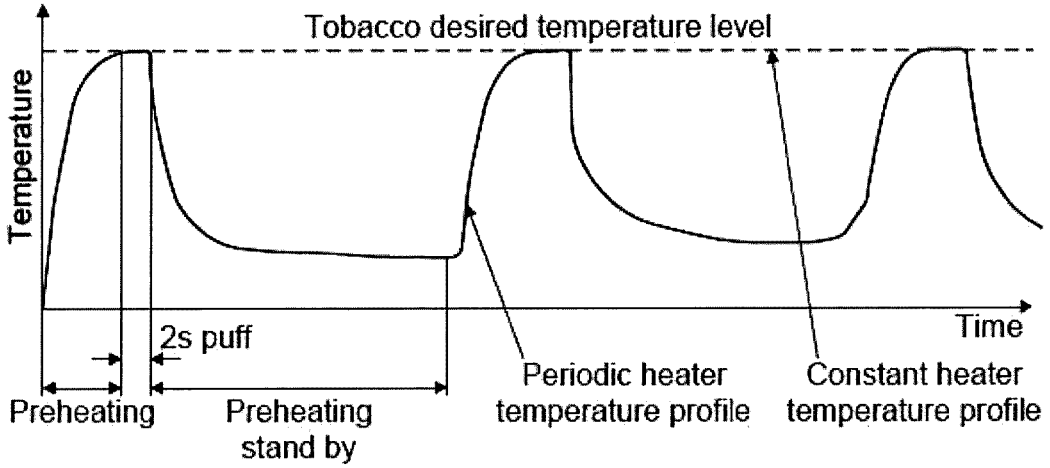
FIG. 7 is a graphical illustration of a heating pattern which can be used to heat smokeable material using a heater.

The controller 12 may be configured to de-activate the heater 3, or reduce the power being supplied to the heater 3, in between puffs. This saves energy and extends the life of the energy source 2. For example, upon the apparatus 1 being switched on by a user or in response to some other stimulus, such as detection of a user placing their mouth against the mouthpiece 6, the controller 12 may be configured to cause the heater 3, or next heating region 10 to be used to heat the smokeable material 5, to be partially activated so that it heats up in preparation to volatilize components of the smokeable material 5. The partial activation does not heat the smokeable material 5 to a sufficient temperature to volatilize nicotine. A suitable temperature could be approximately 100° C. In response to detection of a puff by the puff sensor 13, the controller 12 can then cause the heater 3 or heating region 10 in question to heat the smokeable material 5 further in order to rapidly volatilize the nicotine and other aromatic compounds for inhalation by the user. If the smokeable material 5 comprises tobacco, a suitable temperature for volatilizing the nicotine and other aromatic compounds may be between 150° C. and 250° C. Therefore, an example full activation temperature is 250° C. A super-capacitor can optionally be used to provide the peak current used to heat the smokeable material 5 to the volatization temperature. An example of a suitable heating pattern is shown in FIG. 7, in which the peaks may respectively represent the full activation of different heating regions 10. As can be seen, the smokeable material 5 is maintained at the volatization temperature for the approximate period of the puff which, in this example, is two seconds.

Three example operational modes of the heater 3 are described below.

In a first operational mode, during full activation of a particular heating region 10, all other heating regions 10 of the heater are deactivated. Therefore, when a new heating region 10 is activated, the previous heating region is deactivated. Power is supplied only to the activated region 10.

Alternatively, in a second operational mode, during full activation of a particular heating region 10, one or more of the other heating regions 10 may be partially activated.

Partial activation of the one or more other heating regions 10 may comprise heating the other heating region(s) 10 to a temperature which is sufficient to substantially prevent condensation of components such as nicotine volatized from the smokeable material 5 in the heating chamber 4. The temperature of the heating regions 10 which are partially activated is less than the temperature of the heating region 10 which is fully activated. The smokeable material 10 located adjacent the partially activated regions 10 is not heated to a temperature sufficient to volatize components of the smokeable material 5.

Alternatively, in a third operational mode, once a particular heating region 10 has been activated, it remains fully activated until the heater 3 is switched off. Therefore, the power supplied to the heater 3 incrementally increases as more of the heating regions 10 are activated during inhalation from the cartridge 11. As with the second mode previously described, the continuing activation of the heating regions 10 substantially prevent condensation of components such as nicotine volatized from the smokeable material 5 in the heating chamber 4.

Figure 14:
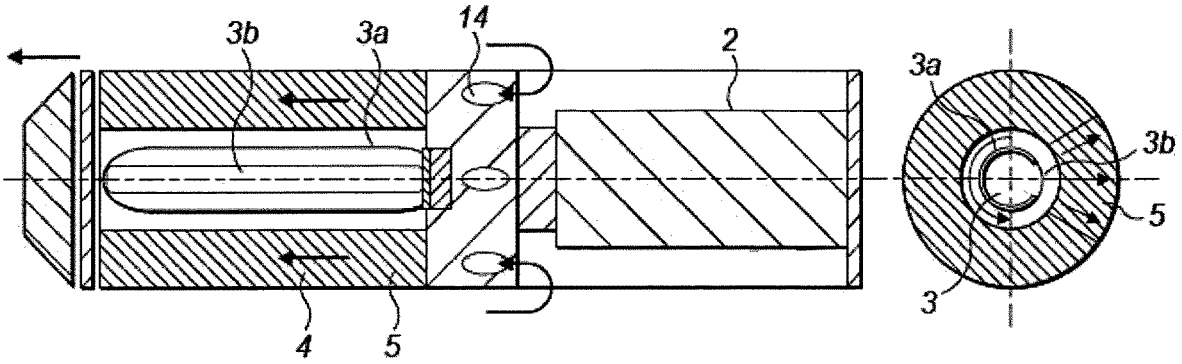
FIG. 14 is a schematic, cross-sectional illustration of a heat shield and a heat-transparent window which are moveable relative to a body of smokeable material to selectively allow thermal energy to be transmitted to different sections of the smokeable material through the window.

The apparatus 1 may comprise a heat shield 3*a*, which is located between the heater 3 and the heating chamber 4/smokeable material 5. The heat shield 3*a* is configured to substantially prevent thermal energy from flowing through the heat shield 3*a* and therefore can be used to selectively prevent the smokeable material 5 from being heated even when the heater 3 is activated and emitting thermal energy. Referring to FIG. 14, the heat shield 3*a* may, for example, comprise a cylindrical layer of heat reflective material which is located co-axially around the heater 3. Alternatively, if the heater 3 is located around the heating chamber 4 and smokeable material 5 as previously described with reference to FIG. 1, the heat shield 3*a* may comprise a cylindrical layer of heat reflective material which is located co-axially around the heating chamber 4 and co-axially inside of the heater 3. The heat shield 3*a* may additionally or alternatively comprise a heat-insulating layer configured to insulate the heater 3 from the smokeable material 5.

The heat shield 3*a* comprises a substantially heat-transparent window 3*b* which allows thermal energy to propagate through the window 3*b* and into the heating chamber 4 and smokeable material 5. Therefore, the section of smokeable material 5 which is aligned with the window 3*b* is heated whilst the remainder of the smokeable material 5 is not. The heat shield 3*a* and window 3*b* may be rotatable or otherwise moveable with respect the smokeable material 5 so that different sections of the smokeable material 5 can be selectively and individually heated by rotating or moving the heat shield 3*a* and window 3*b*. The effect is similar to the effect provided by selectively and individually activating the heating regions 10 referred to above. For example, the heat shield 3*a* and window 3*b* may be rotated or otherwise moved incrementally in response to a signal from the puff detector 13. Additionally or alternatively, the heat shield 3*a* and window 3*b* may be rotated or otherwise moved incrementally in response to a predetermined heating period having elapsed. Movement or rotation of the heat shield 3*a* and window 3*b* may be controlled by electronic signals from the controller 12. The relative rotation or other movement of the heat shield 3*a*/window 3*b* and smokeable material 5 may be driven by a stepper motor 3*c* under the control of the controller 12. This is illustrated in FIG. 14. Alternatively, the heat shield 3*a* and window 3*b* may be manually rotated using a user control such as an actuator on the housing 7. The heat shield 3*a* does not need to be cylindrical and may optionally comprise one or more suitably positioned longitudinally extending elements and or/plates.

It will be appreciated that a similar result can be obtained by rotating or moving the smokeable material 5 relative to the heater 3, heat shield 3*a* and window 3*b*. For example, the heating chamber 4 may be rotatable around the heater 3. If this is the case, the above description relating to movement of the heat shield 3*a* can be applied instead to movement of the heating chamber 4 relative to the heat shield 3*a*.

The heat shield 3*a* may comprise a coating on the longitudinal surface of the heater 3. In this case, an area of the heater's surface is left uncoated to form the heat-transparent window 3*b*. The heater 3 can be rotated or otherwise moved, for example under the control of the controller 12 or user controls, to cause different sections of the smokeable material 5 to be heated. Alternatively, the heat shield 3*a* and window 3*b* may comprise a separate shield 3*a* which is rotatable or otherwise moveable relative to both the heater 3 and the smokeable material 5 under the control of the controller 12 or other user controls.

Figure 6:
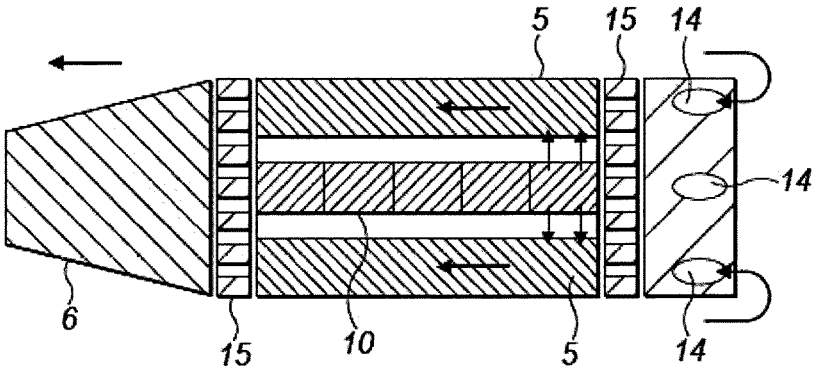
FIG. 6 is a schematic illustration of a gaseous flow through an apparatus configured to heat smokeable material.

The apparatus 1 may comprise air inlets 14 which allow external air to be drawn into the housing 7 and through the heated smokeable material 5 during puffing. The air inlets 14 may comprise apertures 14 in the housing 7 and may be located upstream from the smokeable material 5 and heating chamber 4 towards the first end 8 of the housing 7. This is shown in FIG. 1. Another example is shown in FIG. 6. Air drawn in through the inlets 14 travels through the heated smokeable material 5 and therein is enriched with smokeable material vapours, such as aroma vapours, before being inhaled by the user at the mouthpiece 6. Optionally, as shown in FIG. 6, the apparatus 1 may comprise a heat exchanger 15 configured to warm the air before it enters the smokeable material 5 and/or to cool the air before it is drawn through the mouthpiece 6. For example, the heat exchanger 15 may be configured to use heat extracted from the air entering the mouthpiece 6 to warm new air before it enters the smokeable material 5.

The apparatus 1 may comprise a smokeable material compressor 16 configured to cause the smokeable material 5 to compress upon activation of the compressor 16. The apparatus 1 can also comprise a smokeable material expander 17 configured to cause the smokeable material 5 to expand upon activation of the expander 17. The compressor 16 and expander 17 may, in practice, be implemented as the same unit as will be explained below. The smokeable material compressor 16 and expander 17 may optionally operate under the control of the controller 12. In this case, the controller 12 is configured to send a signal, such as an electrical signal, to the compressor 16 or expander 17 which causes the compressor 16 or expander 17 to respectively compress or expand the smokeable material 5. Alternatively, the compressor 16 and expander 17 may be actuated by a user of the apparatus 1 using a manual control on the housing 7 to compress or expand the smokeable material 5 as required.

The compressor 16 is principally configured to compress the smokeable material 5 and thereby increase its density during heating. Compression of the smokeable material increases the thermal conductivity of the body of smokeable material 5 and therefore provides a more rapid heating and consequent rapid volatization of nicotine and other aromatic compounds. This is preferable because it allows the nicotine and aromatics to be inhaled by the user without substantial delay in response to detection of a puff. Therefore, the controller 12 may activate the compressor 16 to compress the smokeable material 5 for a predetermined heating period, for example one second, in response to detection of a puff. The compressor 16 may be configured to reduce its compression of the smokeable material 5, for example under the control of the controller 12, after the predetermined heating period. Alternatively, the compression may be reduced or automatically ended in response to the smokeable material 5 reaching a predetermined threshold temperature. A suitable threshold temperature may be in the range of approximately 150° C. to 250° C., and may be user selectable. A temperature sensor may be used to detect the temperature of the smokeable material 5.

The expander 17 is principally configured to expand the smokeable material 5 and thereby decrease its density during puffing. The arrangement of smokeable material 5 in the heating chamber 4 becomes more loose when the smokeable material 5 has been expanded and this aids the gaseous flow, for example air from the inlets 14, through the smokeable material 5. The air is therefore more able to carry the volatilized nicotine and aromatics to the mouthpiece 6 for inhalation. The controller 12 may activate the expander 17 to expand the smokeable material 5 immediately following the compression period referred to above so that air can be drawn more freely through the smokeable material 5. Actuation of the expander 17 may be accompanied by a user-audible sound or other indication to indicate to the user that the smokeable material 5 has been heated and that puffing can commence.

Figure 8:
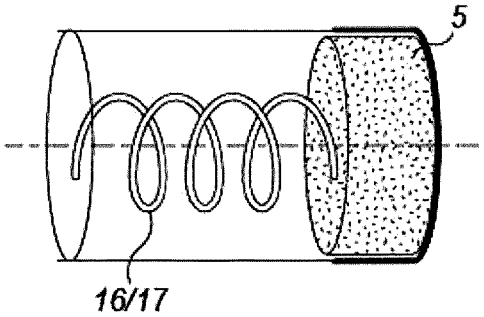
FIG. 8 is a schematic illustration of a smokeable material compressor configured to compress smokeable material during heating.
Figure 9:
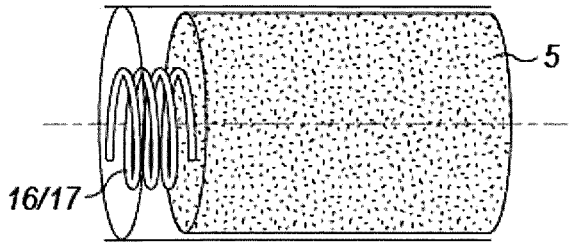
FIG. 9 is a schematic illustration of a smokeable material expander configured to expand smokeable material during puffing.
Figure 10:
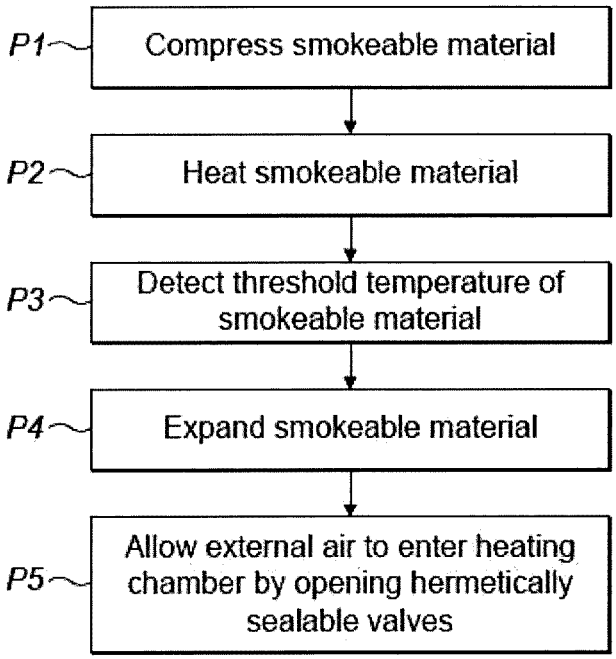
FIG. 10 is a flow diagram showing a method of compressing smokeable material during heating and expanding the smokeable material for puffing.

Referring to FIGS. 8 and 9, the compressor 16 and expander 17 may comprise a spring-actuated driving rod which is configured to compress the smokeable material 5 in the heating chamber 4 when the spring is released from compression. This is schematically illustrated in FIGS. 8 and 9, although it will be appreciated that other implementations could be used. For example, the compressor 16 may comprise a ring, having a thickness approximately equal to the tubular-shaped heating chamber 4 described above, which is driven by a spring or other means into the heating chamber 4 to compress the smokeable material 5. Alternatively, the compressor 16 may be comprised as part of the heater 3 so that the heater 3 itself is configured to compress and expand the smokeable material 5 under the control of the controller 12. A method of compressing and expanding the smokeable material 5 is shown in FIG. 10.

The heater 3 may be integrated with the thermal insulation 18 mentioned previously. For example, referring to FIG. 1, the thermal insulation 18 may comprise a substantially elongate, hollow body, such as a substantially cylindrical tube of insulation 18, which is located co-axially around the heating chamber 4 and into which the heating regions 10 are integrated. The thermal insulation 18 may comprise a layer in which recesses are provided in the inwardly facing surface profile 21. Heating regions 10 are located in these recesses so that the heating regions 10 face the smokeable material 5 in the heating chamber 4. The surfaces of the heating regions 10 which face the heating chamber 4 may be flush with the inside surface 21 of the thermal insulation 18 in regions of the insulation 18 which are not recessed.

The integration of the heater 3 with the thermal insulation 18 means that the heating regions 10 are substantially surrounded by the insulation 18 on all sides of the heating regions 10 other than those which face inwardly towards the smokeable material heating chamber 4. As such, heat emitted by the heater 3 is concentrated in the smokeable material 5 and does not dissipate into other parts of the apparatus 1 or into the atmosphere outside the housing 7.

Integration of the heater 3 with the thermal insulation 18 may also reduce the thickness of the combination of heater 3 and thermal insulation 18. This can allow the diameter of the apparatus 1, in particular the external diameter of the housing 7, to be further reduced. Alternatively, the reduction in thickness provided by the integration of the heater 3 with the thermal insulation 18 can allow a wider smokeable material heating chamber 4 to be accommodated in the apparatus 1, or the introduction of further components, without any increase in the overall width of the housing 7.

Alternatively, the heater 3 may be adjacent the insulation 18 rather than being integrated into it. For example, if the heater 3 is located externally of the heating chamber 4, the insulation 18 may be lined with the film heater 3 around its inwardly-facing surface 21. If the heater 3 is located internally of the heating chamber 4, the insulation 18 may be lined with the film heater 3 on its outwardly-facing surface 22.

Optionally, a barrier may be present between the heater 3 and the insulation 18. For example, a layer of stainless steel may be present between the heater 3 and the insulation 18. The barrier may comprise a stainless steel tube which fits between the heater 3 and the insulation 18. The thickness of the barrier may be small so as not to substantially increase the dimensions of the apparatus. An example thickness is between approximately 0.1 mm and 1.0 mm.

Additionally, a heat reflecting layer may be present between the transverse surfaces of the heating regions 10. The arrangement of the heating regions 10 relative to each other may be such that thermal energy emitted from each one of the heating regions 10 does not substantially heat the neighbouring heating regions 10 and instead travels predominately inwardly from the circumferential surface of the heating region 10 into the heating chamber 4 and smokeable material 5. Each heating region 10 may have substantially the same dimensions as the other regions 10.

The heater 3 may be bonded or otherwise secured in the apparatus 1 using pressure sensitive adhesive. For example, the heater 3 may be adhered to the insulation 18 or barrier referred to above using pressure sensitive adhesive. The heater 3 may alternatively be adhered to the cartridge 11 or an exterior surface of the smokeable material heating chamber 4.

As an alternative to the use of pressure sensitive adhesive, the heater 3 may be secured in position in the apparatus 1 using self-fusing tape or by clamps which clamp the heater 3 in place. All of these methods provide a secure fixing for the heater 3 and allow effective heat transfer from the heater 3 to the smokeable material 5. Other types of fixing are also possible.

The thermal insulation 18, which is provided between the smokeable material 5 and an external surface 19 of the housing 7 as described above, reduces heat loss from the apparatus 1 and therefore improves the efficiency with which the smokeable material 5 is heated. For example, referring to FIG. 1, a wall of the housing 7 may comprise a layer of insulation 18 which extends around the outside of the heating chamber 4. The insulation layer 18 may comprise a substantially tubular length of insulation 18 located co-axially around the heating chamber 4 and smokeable material 5. This is shown in FIG. 1. It will be appreciated that the insulation 18 could also be comprised as part of the smokeable material cartridge 11, in which it would be located co-axially around the outside of the smokeable material 5.

Figure 11:
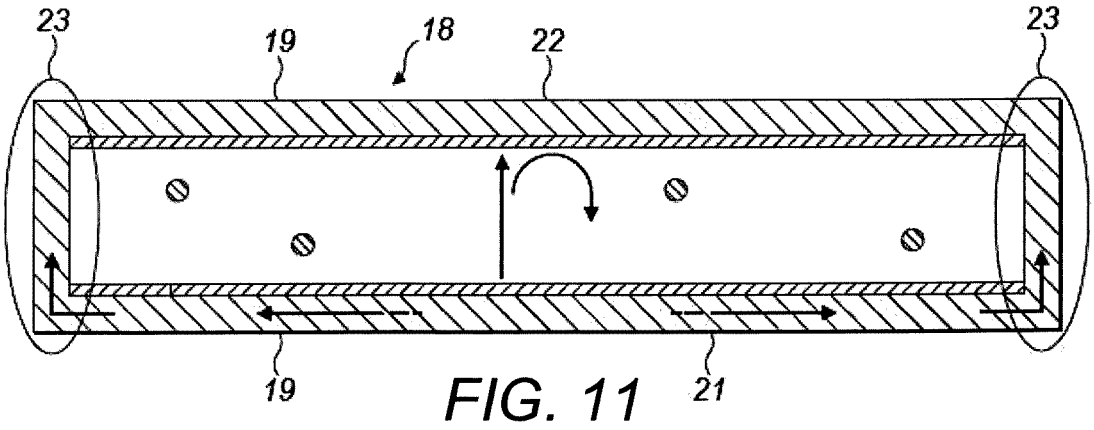
FIG. 11 is a schematic, cross-sectional illustration of a section of vacuum insulation configured to insulate heated smokeable material from heat loss.

Referring to FIG. 11, the insulation 18 may comprise vacuum insulation 18. For example, the insulation 18 may comprise a layer which is bounded by a wall material 19 such as a metallic material. An internal region or core 20 of the insulation 18 may comprise an open-cell porous material, for example comprising polymers, aerogels or other suitable material, which is evacuated to a low pressure. The pressure in the internal region 20 may be in the range of 0.1 to 0.001 mbar. The wall 19 of the insulation 18 is sufficiently strong to withstand the force exerted against it due to the pressure differential between the core 20 and external surfaces of the wall 19, thereby preventing the insulation 18 from collapsing. The wall 19 may, for example, comprise a stainless steel wall 19 having a thickness of approximately 100 μm. The thermal conductivity of the insulation 18 may be in the range of 0.004 to 0.005 W/mK. The heat transfer coefficient of the insulation 18 may be between approximately 1.10 W/($m^2$K) and approximately 1.40 W/($m^2$K) within a temperature range of between approximately 150 degrees Celsius and approximately 250 degrees Celsius. The gaseous conductivity of the insulation 18 is negligible. A reflective coating may be applied to the internal surfaces of the wall material 19 to minimize heat losses due to radiation propagating through the insulation 18. The coating may, for example, comprise an aluminium IR reflective coating having a thickness of between approximately 0.3 μm and 1.0 μm. The evacuated state of the internal core region 20 means that the insulation 18 functions even when the thickness of the core region 20 is very small. The insulating properties are substantially unaffected by its thickness. This helps to reduce the overall size of the apparatus 1.

As shown in FIG. 11, the wall 19 may comprise an inwardly-facing section 21 and an outwardly-facing section 22. The inwardly-facing section 21 substantially faces the smokeable material 5 and heating chamber 4. The outwardly-facing section 22 substantially faces the exterior of the housing 7. During operation of the apparatus 1, the inwardly-facing section 21 may be warmer due to the thermal energy originating from the heater 3, whilst the outwardly-facing section 22 is cooler due to the effect of the insulation 18. The inwardly-facing section 21 and the outwardly-facing section 22 may, for example, comprise substantially parallel longitudinally-extending walls 19 which are at least as long as the heater 3. The internal surface of the outwardly-facing wall section 22, i.e. the surface facing the evacuated core region 20, may comprise a coating for absorbing gas in the core 20. A suitable coating is a titanium oxide film.

The thermal insulation 18 may comprise hyper-deep vacuum insulation such as an INSULON® Shaped-Vacuum Thermal Barrier as described in U.S. Pat. No. 7,374,063. The overall thickness of such insulation 18 may be extremely small. An example thickness is between approximately 1 mm and approximately 1 μm, such as approximately 0.1 mm, although other larger or smaller thicknesses are also possible. The thermally insulating properties of the insulation 18 are substantially unaffected by its thickness and therefore thin insulation 18 can be used without any substantial additional heat loss from the apparatus 1. The very small thickness of the thermal insulation 18 may allow the size of the housing 7 and apparatus 1 as a whole to be reduced beyond the sizes previously discussed and may allow the thickness, for example the diameter, of the apparatus 1 to be approximately equal to smoking articles such as cigarettes, cigars and cigarillos. The weight of the apparatus 1 may also be reduced, providing similar benefits to the size reductions discussed above.

Although the thermal insulation 18 described previously may comprise a gas-absorbing material to maintain or aid with creation of the vacuum in the core region 20, a gas absorbing material is not used in the deep-vacuum insulation 18. The absence of the gas absorbing material aids with keeping the thickness of the insulation 18 very low and thus helps to reduce the overall size of the apparatus 1.

Figure 16:
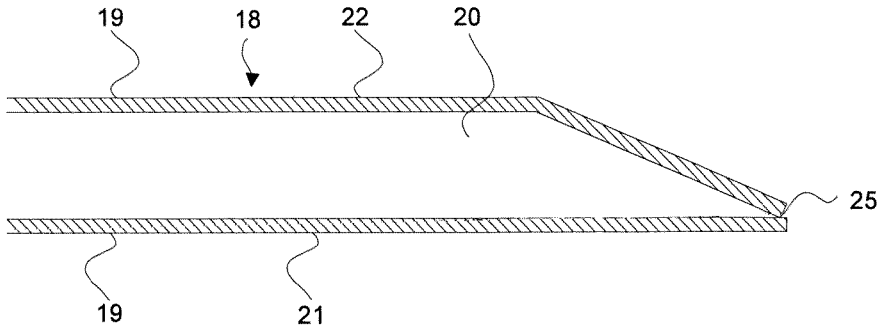
FIG. 16 is a schematic, cross sectional illustration of a partial section of deep-vacuum insulation configured to thermally insulate an apparatus configured to heat smokeable material.

The geometry of the hyper-deep insulation 18 allows the vacuum in the insulation to be deeper than the vacuum used to extract molecules from the core region 20 of the insulation 18 during manufacture. For example, the deep vacuum inside the insulation 18 may be deeper than that of the vacuum-furnace chamber in which it is created. The vacuum inside the insulation 18 may, for example, be of the order $10^{-7}$ Torr. Referring to FIG. 16, an end of the core region 20 of the deep-vacuum insulation 18 may taper as the outwardly facing section 22 and inwardly facing section 21 converge to an outlet 25 through which gas in the core region 20 may be evacuated to create a deep vacuum during manufacture of the insulation 18. FIG. 16 illustrates the outwardly facing section 22 converging towards the inwardly facing section 21 but a converse arrangement, in which the inwardly facing section 21 converges to the outwardly facing section 22, could alternatively be used. The converging end of the insulating wall 19 is configured to guide gas molecules in the core region 20 out of the outlet 25 and thereby create a deep vacuum in the core 20. The outlet 25 is sealable so as to maintain a deep vacuum in the core region 20 after the region 20 has been evacuated. The outlet 25 can be sealed, for example, by creating a brazed seal at the outlet 25 by heating brazing material at the outlet 25 after gas has been evacuated from the core 20. Alternative sealing techniques could be used.

In order to evacuate the core region 20, the insulation 18 may be placed in a low pressure, substantially evacuated environment such as a vacuum furnace chamber so that gas molecules in the core region 20 flow into the low pressure environment outside the insulation 18. When the pressure inside the core region 20 becomes low, the tapered geometry of the core region 20, and in particular the converging sections 21, 22 referred to above, becomes influential in guiding remaining gas molecules out the core 20 via the outlet 25. Specifically, when the gas pressure in the core region 20 is low, the guiding effect of the converging inwardly and outwardly facing sections 21, 22 is effective to channel the remaining gas molecules inside the core 20 towards the outlet 25 and make the probability of gas exiting the core 20 higher than the probability of gas entering the core 20 from the external, low pressure environment. In this way, the geometry of the core 20 allows the pressure inside the core 20 to be reduced below the pressure of the environment outside the insulation 18.

Optionally, as previously described, one or more low emissivity coatings may be present on the internal surfaces of the inwardly and outwardly facing sections 21, 22 of the wall 19 in order to substantially prevent heat losses by radiation.

Although the shape of the insulation 18 is generally described herein as substantially cylindrical or similar, the thermal insulation 18 could be another shape, for example in order to accommodate and insulate a different configuration of the apparatus 1 such as different shapes and sizes of heating chamber 4, heater 3, housing 7 or energy source 2. For example, the size and shape of deep-vacuum insulation 18 such as an INSULON® Shaped-Vacuum Thermal Barrier referred to above is substantially unlimited by its manufacturing process. Suitable materials for forming the converging structure described above include ceramics, metals, metalloids and combinations of these.

Figure 12:
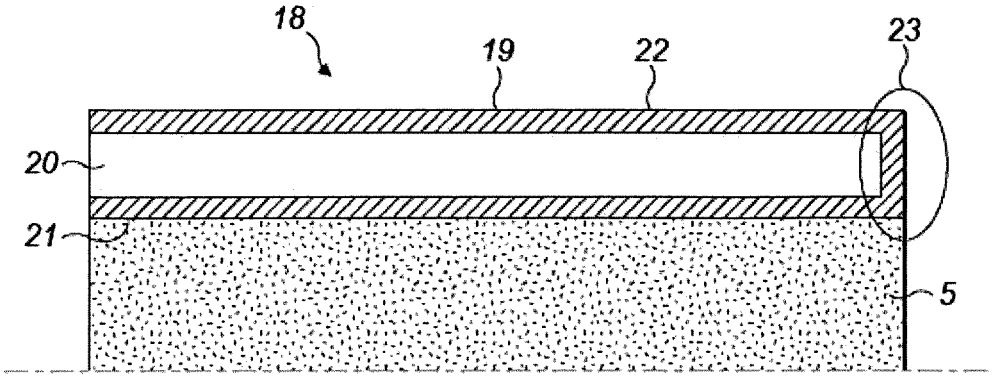
FIG. 12 is another schematic, cross-sectional illustration of a section of vacuum insulation configured to insulate heated smokeable material from heat loss.

Referring to the schematic illustration in FIG. 12, a thermal bridge 23 may connect the inwardly-facing wall section 21 to the outwardly-facing wall section 22 at one or more edges of the insulation 18 in order to completely encompass and contain the low pressure core 20. The thermal bridge 23 may comprise a wall 19 formed of the same material as the inwardly and outwardly-facing sections 21, 22. A suitable material is stainless steel, as previously discussed. The thermal bridge 23 has a greater thermal conductivity than the insulating core 20 and therefore may undesirably conduct heat out of the apparatus 1 and, in doing so, reduce the efficiency with which the smokeable material 5 is heated.

Figure 13:
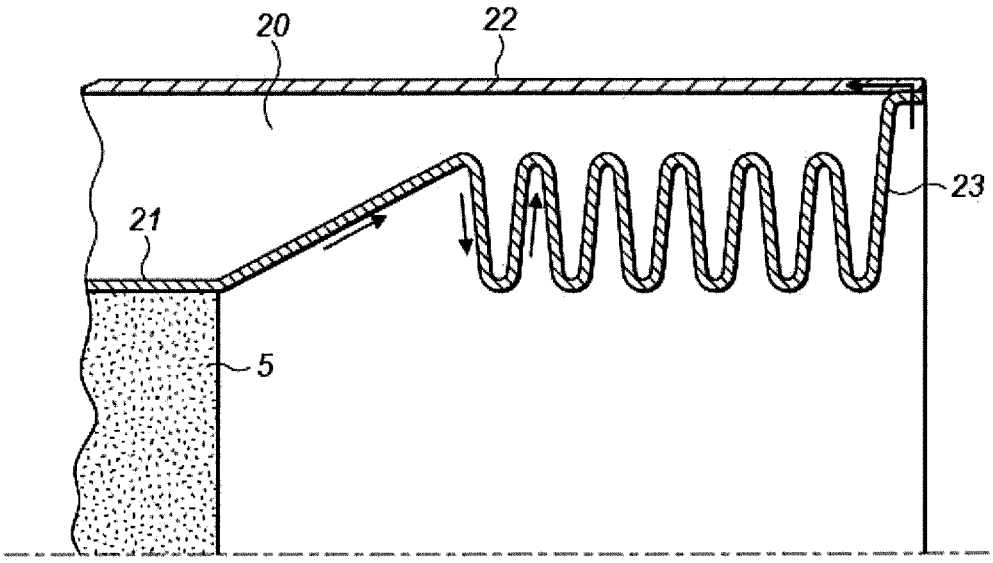
FIG. 13 is a schematic, cross-sectional illustration of a heat resistive thermal bridge which follows an indirect path from a higher temperature insulation wall to a lower temperature insulation wall.

To reduce heat losses due to the thermal bridge 23, the thermal bridge 23 may be extended to increase its resistance to heat flow from the inwardly-facing section 21 to the outwardly-facing section 22. This is schematically illustrated in FIG. 13. For example, the thermal bridge 23 may follow an indirect path between the inwardly-facing section 21 of wall 19 and the outwardly-facing section 22 of wall 19. This may be facilitated by providing the insulation 18 over a longitudinal distance which is longer than the lengths of the heater 3, heating chamber 4 and smokeable material 5 so that the thermal bridge 23 can gradually extend from the inwardly-facing section 21 to the outwardly-facing section 22 along the indirect path, thereby reducing the thickness of the core 20 to zero, at a longitudinal location in the housing 7 where the heater 3, heating chamber 4 and smokeable material 5 are not present.

Figure 15:
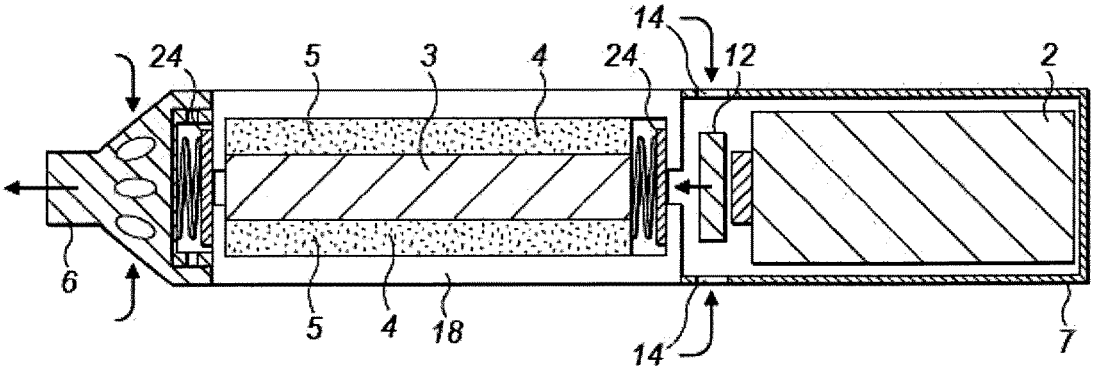
FIG. 15 is schematic, cross sectional illustration of part of an apparatus configured to heat smokeable material, in which a heating chamber is hermetically sealable by check valves.

Referring to FIG. 15, as previously discussed, the heating chamber 4 insulated by the insulation 18 may comprise inlet and outlet valves 24 which hermetically seal the heating chamber 4 when closed. The valves 24 can thereby prevent air from undesirably entering and exiting the chamber 4 and can prevent smokeable material flavours from exiting the chamber 4. The inlet and outlet values 24 may, for example, be provided in the insulation 18. For example, between puffs, the valves 24 may be closed by the controller 12 so that all volatilized substances remain contained inside the chamber 4 in-between puffs. The partial pressure of the volatized substances between puffs reaches the saturated vapour pressure and the amount of evaporated substances therefore depends only on the temperature in the heating chamber 4. This helps to ensure that the delivery of volatilized nicotine and aromatic compounds remains constant from puff to puff. During puffing, the controller 12 is configured to open the valves 24 so that air can flow through the chamber 4 to carry volatilized smokeable material components to the mouthpiece 6. A membrane can be located in the valves 24 to ensure that no oxygen enters the chamber 4. The valves 24 may be breath-actuated so that the valves 24 open in response to detection of a puff at the mouthpiece 6. The valves 24 may close in response to a detection that a puff has ended. Alternatively, the valves 24 may close following the elapse of a predetermined period after their opening. The predetermined period may be timed by the controller 12. Optionally, a mechanical or other suitable opening/closing means may be present so that the valves 24 open and close automatically. For example, the gaseous movement caused by a user puffing on the mouthpiece 6 may be used to open and close the valves 24. Therefore, the use of the controller 12 is not necessarily required to actuate the valves 24.

The mass of the smokeable material 5 which is heated by the heater 3, for example by each heating region 10, may be in the range of 0.2 to 1.0 g. The temperature to which the smokeable material 5 is heated may be user controllable, for example to any temperature within the temperature range of 150° C. to 250° C. as previously described. The mass of the apparatus 1 as a whole may be in the range of 70 to 125 g, although the mass of the apparatus 1 can be lower when incorporating the film heater 3 and/or deep-vacuum insulation 18. A battery 2 with a capacity of 1000 to 3000 mAh and voltage of 3.7V can be used. The heating regions 10 may be configured to individually and selectively heat between approximately 10 and 40 sections of smokeable material 5 for a single cartridge 11.

It will be appreciated that any of the alternatives described above can be used singly or in combination.

In order to address various issues and advance the art, the entirety of this disclosure shows by way of illustration various embodiments in which the claimed invention(s) may be practiced and provide for superior apparatus. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus, comprising:

an elongate housing; a heat chamber configured to receive smokeable material; and a film heater disposed within the elongate housing and configured to heat the heat chamber such that, in use, the smokeable material received in the heat chamber is heated to volatilize at least one component of the smokeable material for inhalation, the film heater comprising a plurality of independently operable heating regions aligned with each other along a longitudinal axis of the film heater to provide a plurality of independent heating zones along the length of the film heater.

2. The apparatus according to claim 1, wherein the film heater is a polyimide film heater.

3. The apparatus according to claim 1, wherein the film heater has a thickness of less than 1 mm.

4. The apparatus according to claim 1, wherein the film heater has a thickness of less than 0.5 mm.

5. The apparatus according to claim 1, wherein the film heater has a thickness of between approximately 0.2 mm and 0.0002 mm.

6. The apparatus according to claim 1, further comprising thermal insulation, wherein the thermal insulation is separated from the film heater by a barrier.

7. The apparatus according to claim 6, wherein the barrier comprises a layer of stainless steel.

8. The apparatus according to claim 1, further comprising a mouthpiece configured for user inhalation of volatized components of the smokeable material.

9. The apparatus according to claim 1, wherein the apparatus is configured to heat the smokeable material without combusting the smokeable material.

10. An apparatus according to claim 1, further comprising smokeable material to be received in the apparatus.

11. The apparatus according to claim 1, further comprising thermal insulation or heat reflective material, wherein the plurality of independently operable heating regions are longitudinally separated from one another by the thermal insulation or heat reflective material.

12. The apparatus according to claim 1, further comprising a controller configured to cause the heater to be partially activated so that the heater heats up in preparation to volatilize components of the smokeable material.

13. The apparatus according to claim 12, wherein partial activation of the heater comprises causing a heating region to be partially activated.

14. The apparatus according to claim 1, further comprising a controller configured to cause a first heating region to be partially activated so as to attain a first temperature, and to cause a second heating region to be fully activated so as to attain a second temperature, the first temperature being less than the second temperature.

15. The apparatus according to claim 14, wherein the controller is configured to cause the first heating region to be partially activated while the second heating region is fully activated.

16. The apparatus according to claim 11, wherein the thermal insulation forms a thermal insulation layer that is integrated with the film heater.

17. The apparatus according to claim 11, wherein the thermal insulation is lined with the film heater.

18. The apparatus according to claim 11, wherein a thickness of the thermal insulation or heat reflective material is less than approximately 1 mm.

19. A method, comprising:

manufacturing an apparatus comprising an elongate housing; a heat chamber configured to receive smokeable material; and a film heater disposed within the elongate housing and configured to heat the heat chamber such that, in use, the smokeable material received in the heat chamber is heated to volatilize at least one component of the smokeable material for inhalation, the film heater comprising a plurality of independently operable heating regions aligned with each other along a longitudinal axis of the film heater to provide a plurality of independent heating zones along the length of the film heater.

20. An apparatus, comprising:

an elongate housing;

a heat chamber configured to receive smokeable material;

a film heater disposed within the elongate housing and configured to heat the heat chamber such that, in use, smokeable material received in the heat chamber is heated to volatilize at least one compound from the smokeable material without combustion of the smokeable material, the film heater comprising a plurality of independently operable heating regions aligned with each other along a longitudinal axis of the film heater to provide a plurality of independent heating zones along the length of the film heater;

a power source disposed within the elongate housing and configured to provide power to the film heater; and an inhalation mouthpiece disposed at an end of the elongate housing configured such that, in use, at least one compound volatized from smokeable material received in the heat chamber can be inhaled by a user of the apparatus.

21. A method of heating smokeable material to volatilize at least one component of the smokeable material for inhalation, comprising heating the smokeable material by the apparatus of claim 1.

* * * * *